US005126913A

United States Patent [19]

Araya et al.

[11] Patent Number: 5,126,913

[45] Date of Patent: Jun. 30, 1992

[54] CHARGING DEVICE WITH CONTACTABLE CHARGING MEANS AND AN IMAGE FORMING APPARATUS HAVING THE CHARGING MEANS AND A DETACHABLE PROCESS UNIT

[75] Inventors: Junji Araya; Masanobu Saito, both of Yokohama; Hiroki Kisu, Ichikawa; Yohji Tomoyuki, Yokohama; Shunji Nakamura, Yokohama; Noribumi Koitabashi, Yokohama; Hiroyuki Adachi, Tokyo, all of Japan

[73] Assignee: Canon Kabushiki Kaisha, Tokyo, Japan

[21] Appl. No.: 753,027

[22] Filed: Aug. 29, 1991

Related U.S. Application Data

[63] Continuation of Ser. No. 656,030, Feb. 15, 1991, abandoned, which is a continuation of Ser. No. 408,434, Sep. 14, 1989, abandoned, which is a continuation of Ser. No. 243,716, Sep. 13, 1988, abandoned.

[30] Foreign Application Priority Data

| | | | |
|---|---|---|---|
| Sep. 14, 1987 | [JP] | Japan | 62-230333 |
| Sep. 14, 1987 | [JP] | Japan | 62-230334 |
| Oct. 5, 1987 | [JP] | Japan | 62-251294 |
| Dec. 26, 1987 | [JP] | Japan | 62-331149 |
| Dec. 26, 1987 | [JP] | Japan | 62-331150 |

[51] Int. Cl.[5] ..... G03G 15/02

[52] U.S. Cl. ..... 361/225; 355/219

[58] Field of Search ..... 355/219, 210, 200, 77; 361/225

[56] References Cited

U.S. PATENT DOCUMENTS

| | | | |
|---|---|---|---|
| 2,934,649 | 4/1960 | Walkup | 355/219 |
| 2,980,834 | 4/1961 | Tregay et al. | 361/225 |
| 3,626,260 | 12/1971 | Kimura et al. | 361/225 |
| 3,778,690 | 12/1973 | Rothacker et al. | 361/225 |
| 4,380,384 | 1/1981 | Ueno et al. | 355/3 CH |
| 4,851,960 | 7/1989 | Nakamura et al. | 361/225 |

FOREIGN PATENT DOCUMENTS

| | | |
|---|---|---|
| 035745 | 9/1981 | European Pat. Off. . |
| 0272072 | 6/1988 | European Pat. Off. . |
| 3101678 | 12/1981 | Fed. Rep. of Germany . |
| 57-72157 | 5/1982 | Japan . |

*Primary Examiner*—R. L. Moses

*Attorney, Agent, or Firm*—Fitzpatrick, Cella, Harper & Scinto

[57] ABSTRACT

A charging device for charging a moving member to be charged includes charging device for being contacted to the member to be charged to charge the member; a voltage source for applying a vibratory voltage to the charging device; wherein the charging device includes a first layer contactable to the member to be charged, a second layer adjacent thereto wherein the first layer is a dielectric layer having a volume resistivity larger than that of the second layer.

78 Claims, 10 Drawing Sheets

CHARGING DEVICE WITH CONTACTABLE CHARGING MEANS AND AN IMAGE FORMING APPARATUS HAVING THE CHARGING MEANS AND A DETACHABLE PROCESS UNIT

This application is a continuation of application Ser. No. 07/656,030 filed Feb. 15, 1991, now abandoned, which is a continuation of application Ser. No. 07/408,434 filed Sep. 14, 1989, now abandoned, which is a continuation of application Ser. No. 07/243,716 filed Sep. 13, 1988, now abandoned.

FIELD OF THE INVENTION AND RELATED ART

The present invention relates to a charging device usable with an electrophotographic copying machine, a laser beam printer or the like wherein a charging member to which an external voltage is applied is contacted to a member to be charged such as a movable photosensitive member in the form of a drum or in the form of a belt.

The description will be made with an exemplary charging process to a photosensitive member as a member to be charged in an electrophotographic copying machine.

As is well known, an electrophotographic copying machine includes a step of uniformly charging the surface of the photosensitive member functioning as an image bearing member to a predetermined potential. Generally, a corona discharger comprising a wire electrode and a shield electrode is used as the charging means. However, the corona discharging means used as the charging means for the photosensitive member requires a high voltage such as several KV to applied to the wire electrode. In addition, in order to maintain a large distance between the wire electrode and the shield electrode to prevent the leakage to the shield electrode and the main assembly of the apparatus, the size of the discharger has to be large; and a relatively large amount of ozone is produced by the corona discharge, involving the problems of the deterioration of the photosensitive member and the blurred image or the like Accordingly, it is recently considered that the corona discharger involving such problems is not used and that another charging means is used which is contacted to the photosensitive member to charge it. Using such a charging member, the problems of the high voltage application and the ozone production or the like of the corona discharger described above, can be eliminated. As for the charging member to be contacted to the member to be charged, a conductive fiber brush or a conductive roller made of a conductive elastic roller or the like to which a DC voltage (approximately 1KV) or a combined DC voltage and AC voltage is externally applied, is contacted to the surface of the photosensitive member to electrically charge the surface to a predetermined potential.

However, there is a problem, when the charging member is contacted to the surface of the photosensitive member and charges it, that the surface of the photosensitive member is not uniformly charged, but a spotty non-uniformness results.

Although the low voltage (approximately 1KV-2KV) as compared with the conventional corona discharger, is enough to provide a desired potential (approximately 500V-1000V) on the photosensitive member, it has been found that since the charging member is contacted to the surface of the photosensitive member, presence of pin holes of the photosensitive member or presence or foreign matter such as metal powder or the like establishes a conductive path between the charging member supplied with the voltage and the pin holes or the metal powder, resulting in an excessive electric current Such a leakage of the current to the photosensitive member results in reduction of the voltage of the charging member not only in the pin hole portions, but also over the entire longitudinal contact area between the charging member and the photosensitive member, and the electric charge is not deposited on the longitudinal area, with the result that the production of the noncharged area.

Referring to FIGS. 1A and 1B, there is shown a mechanism of this phenomena. In FIG. 1A, reference numeral 1 designates a photosensitive member as a member to be charged movable in a direction indicated by an arrow; P is a pin hole in the photosensitive member; 2 is a charging member supplied with a voltage and contacted to the surface of the photosensitive member to charge the surface of the photosensitive member 1. FIG. 1B is an equivalent circuit of the structure of FIG. 1A. In the pin hole of the photosensitive member 1, the electric resistance of the photosensitive member is low as compared with the other portion thereof, so that an excessive current I tends to flow by contact or approaching of the charging member 2 thereto. If the excessive current flows, the voltages $V_A$, $V_B$ . . . $V_Z$ applied onto the photosensitive member are substantially 0V at any position on the longitudinal of the photosensitive member (the line of contact between the photosensitive member and the contacting charging member), and therefore, the charge is not deposited on the entire longitudinal contact area including the pin hole portion.

If the above phenomena occurs during the charging process of the photosensitive member, the output image includes a non-developed portion extending in the length of the photosensitive member corresponding to the non-charged portion, which results in a white stripe in a regular development, in which insufficiently charged portions are not developed, or a black stripe in a reverse development in which the insufficiently charged portions are developed. Thus, the image quality is remarkably degraded. Therefore, the excessive current to the backing electrode of the photosensitive member is liable to cause an erroneous operation of or damage to the electric control system of the electrophotographic copying machine. The pin holes P are produced in the producing process of the image bearing member or the photosensitive member or the like, or produced by mechanical damage, or by dielectric breakdown. It is difficult to completely eliminate the pin holes P.

It has been proposed in U.S. Ser. No. 131,585 or 159,917 that the photosensitive member is uniformly charged by applying a vibratory voltage such as an alternating voltage having a peak-to-peak voltage which is not less than twice the absolute value of the charge starting voltage for the photosensitive member by a charging member contacted thereto.

Although it is possible to uniformly charge the photosensitive member by applying this technique to the electrophotographic copying machine, the U.S. applications do not deal with the problem arising from the leakage current through the pin holes resulting in the production of non-charged portion extending along the length of the photosensitive member.

A means for preventing the leakage current to the photosensitive member is proposed in Japanese Laid-Open patent Applications Nos. 49960/1983 and 224871/1984. However, the proposals are not satisfactory to prevent the current leakage, and also are not satisfactory in the uniformness of the charging.

SUMMARY OF THE INVENTION

Accordingly, it is a principal object of the present invention to provide a charging device supplied with a voltage and contacted to a member to be charged, and which is improved in the current leakage from the charging means to the member to be charged, so that the production of non-charged portion is prevented.

It is another object of the present invention to provide a charging device by which a voltage-supplied charging member is contacted to the member to be charged to uniformly charge it.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 2:
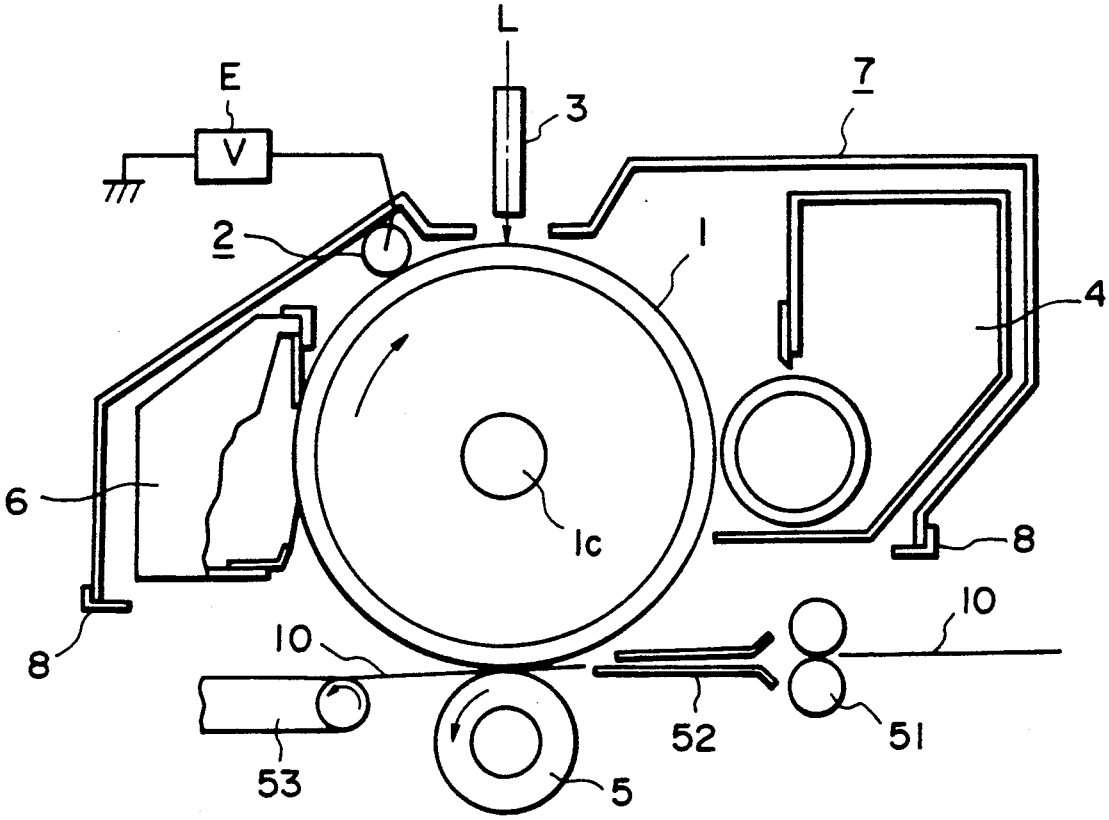
FIG. 2 shows a general arrangement of an image forming apparatus incorporating the charging device of the present invention.

Referring to FIG. 2, there is shown a general arrangement of an image forming apparatus incorporating a charging device according to an embodiment of the present invention. In this embodiment, it is an electrophotographic copying apparatus of an image transfer type using a demountable process cartridge.

The image forming apparatus comprises an image bearing member in the form of a drum type electrophotographic photosensitive member which will hereinafter be called "photosensitive member" rotationally driven at a predetermined peripheral speed in a direction indicated by an arrow about a shaft 1*c*. It further comprises a contacting charging member as a means for uniformly charging the peripheral surface of the photosensitive member 1 as the member to be charged, image exposure means 3 in the form of a short focus lens array, a developing device 4, an image transfer device 5, a timing roller 51 for feeding a transfer material 10 picked one by one out of an unshown paper feeding station to a space between the photosensitive member 1 and the transfer device 5 at a synchronized timing with the rotation of the photosensitive member 1, a transfer material guiding member 52 disposed between the timing roller 51 and the transfer device 5, a conveying device 53 for transporting the transfer material 10 having received the image by passing through the space between the photosensitive member 1 and the transfer device 5 to an unshown image fixing device and a cleaning device for cleaning the surface of the photosensitive member 1 after the image has been transferred therefrom to the transfer material 10.

In this apparatus, the photosensitive member 1, the contact type charging member 2, the developing device 4 and the cleaning device 6 are contained in and constituted as a process cartridge 7. The process cartridge 7 can be mounted into the main assembly of the copying apparatus along supporting rails 8 and 8 in the direction perpendicular to a sheet of the drawing of FIG. 2, and it can be demounted from the main assembly.

When the process cartridge 7 is inserted sufficiently into the main assembly, the process cartridge 7 is mechanically and electrically coupled with the main assembly to become operable as a copying apparatus.

In operation, the peripheral surface of the photosensitive member 1 is uniformly charged by a contact type charging member 2 supplied with a voltage (bias) from a high voltage source E when the photosensitive member 1 rotates. Then the photosensitive member 1 is sequentially exposed to light image L (slit exposure of an original image) when it passes by the position of the image exposure means, so that an electrostatic latent image corresponding to the light image pattern is sequentially formed. A housing wall of the process cartridge 7 is provided with an opening 7*a* for allowing passage of light, disposed at a position corresponding to the light image projecting means 3. The light image can be projected onto the photosensitive member by a laser beam scanning device. In the case of an electrostatic recording apparatus, a means such as an array of electrodes selectively discharges the surface of the photosensitive member to form an electrostatic latent image on the surface of the photosensitive member.

The latent image formed on the surface of the photosensitive member is sequentially developed by the developing device 4 into a toner image (visualized image), and the toner image is transferred onto a surface of the transfer material 10 by the transfer device 5, the transfer material 10 having been transferred from the unshown sheet feeding station into the space between the transfer device 5 and the photosensitive member 1, in a timed relation with the rotation of the photosensitive member 1 by the function of the timing roller 51.

The transfer material 10 having received the image by passing by the transfer device 5 is separated from the surface of the photosensitive member 1, and is introduced into the unshown image fixing device by a conveying device 53, and it is subjected to an image fixing operation, and finally discharged as a print or copy.

On the other hand, the surface of the photosensitive member 1, after the image is transferred, is cleaned by the cleaning device 6, so that the toner not transferred, paper dust produced from the transfer material and other contamination are removed to be prepared for the repeated image formation.

Figure 3:
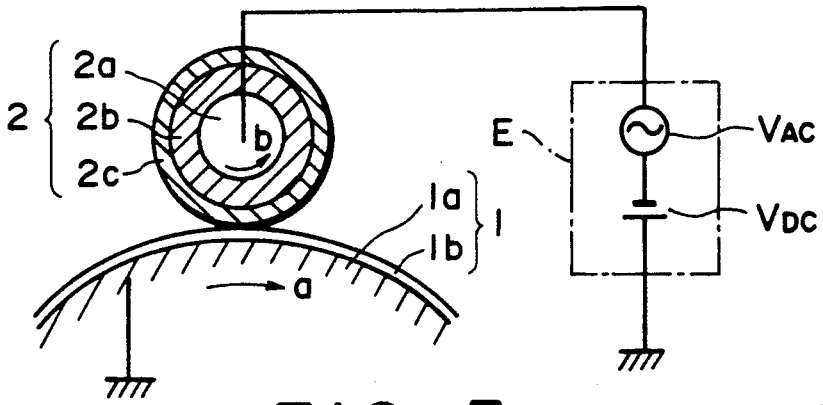
FIG. 3 is a cross-sectional view of the FIG. 1A device.

FIG. 3 shows a charging device according to an embodiment of the present invention, wherein reference numeral 1 designates a part of the electrophotographic photosensitive drum which is a member to be charged the photosensitive drum 1 includes a base drum 1*a* made of aluminum having a photosensitive layer on the outer surface thereof, the photosensitive layer being made of an organic photoconductor (OPC) 1*b*. The outer diameter of the drum 1 is 30 mm, and the drum is rotatable in the direction indicated by an arrow a at a predetermined speed. The charging member in the form of a charging roller 2 is contacted to the photosensitive drum 1 a predetermined pressure The charging roller 2 rotates in the direction indicated by an arrow b following the rotation of the photosensitive drum. The charging roller 2 may be rotated in the same or opposite direction at the contact area between the photosensitive drum 1 and the charging roller 2, but from the standpoint of the friction between the photosensitive drum 1 and the charging roller 2, it is desirable that the roller 2 is rotated positively or following the photosensitive drum, in the same peripheral direction and at the same speed at the contact area between. The charging roller 2 is supplied with a voltage from the voltage source E which applies to the core metal 2*a* (electrode) of the charging roller 2 a voltage ($V_{DC}+V_{AC}$) which is a combination of a DC voltage $V_{DC}$ and an AC voltage $V_{AC}$.

The charging roller 2 is of a three layer structure including the core metal, and comprises the metal core 2*a* (third layer), a conductive elastic layer 2*b* (second layer) and a resistance or dielectric surface layer (first layer) 2*c* thereon. The outer diameter thereof is 12 mm. Here, the dielectric layer is a layer with which an electrostatic capacity of the charging member can be measured by an electrostatic capacity meter.

The materials of the conductive elastic layer 2*b* and the surface layer 2*c* are conductive rubber such as EPDM and regenerated cellulose having a thickness of 10 microns, in this embodiment. The resistance of the conductive elastic layer 2*b* is negligibly small as compared with that of the surface layer 2*c*, more particularly, it is not more than $10^3$ ohm. The resistance R of the charging roller 2 is approximately $10^7$ ohm, and the electrostatic capacity E is approximately 1800 pF. The above resistance and the electrostatic capacity are based on 1 $cm^2$ of the roller surface. The electrostatic capacity Cd of the photosensitive drum 1 per 1 $cm^2$ is approximately 140 pF.

The charging roller 2 may be of four layer structure including the core metal. The charging member is described in the form of a rotatable roller, but it may be a non-rotatable roller, a pad in the form of a blade or the like.

The charging roller 2 contacted to the photosensitive member 1 is preferably such that the voltage applied to the core metal 2*a* (electrode) from the external voltage source 3 is applied between the photosensitive member 1 and the surface layer of the charging roller without attenuation by the resistance of the first layer 2*c* and the second layer 2*b*. To accomplish this, it is possible, for example, to disperse a great amount of conductive powder in the roller 2 to reduce the resistance. However, if the surface of the photosensitive member 1 has a flaw or the like, the low resistance of the roller 2 tends to result in voltage drop of the external voltage source by an excessive current, as described hereinbefore. Therefore, from the standpoint of the charging property, the low resistance of the roller 2 is desirable whereas from the standpoint of preventing the voltage drop resulting from the flaw, the high resistance of the roller 2 is desirable. It is noted, however, that the resistance which is desirably low because of the charging property is the resistance over the entire contact area between the roller and the photosensitive member, whereas the resistance which is desirably high because of the prevention of the voltage drop is the resistance between the core metal 2*a* and the surface flaw of the surface of the photosensitive member. In consideration of this, the volume resistivity of the outermost resistance layer 2*c* directly contacted to the photosensitive member (member to be charged) is larger than the volume resistivity of the second layer 2*b* contacted to the back side of the outermost layer 2*c*.

Figure 4:
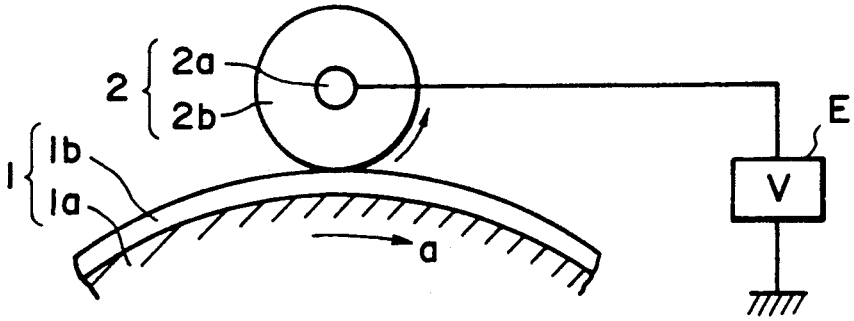
FIG. 4 is a cross-sectional view of a conventional charging device.

FIG. 4 shows a contact type charging device having a core metal 2*a* and the resistance layer 2*b* only, as a comparison example.

Referring back to FIG. 3, the three layer charging roller 2 has a resistance R1 relative to the photosensitive member 1, $$R1 = \frac{\rho 1 r2}{ld} \ln \frac{r2}{r1} + \frac{\rho 2(r2 + t)}{ld} \ln \left( \frac{r2 + t}{r2} \right) \quad (1)$$

ρ1: volume resistivity of the first layer 2*b*
ρ2: volume resistivity of the second layer 2*c*
r1: radius of the core metal 2*a*
r2: radius (outer) of the second layer 2*b*
t: thickness of the first layer 2*c*
d: nip width between the charging roller 2 and the photosensitive member 1
l: length of the nip The resistance R2 of the charging roller having a single layer 2*b* as shown in FIG. 4, relative to the photosensitive member 1, is, $$R2 = \frac{\rho 1 r2}{ld} \ln \frac{r2}{r1} \quad (2)$$

The increase Δ of the resistance of the charging roller 2 by the provision of the first layer 2c is $$\Delta R = \frac{\rho 2(r2 + t)}{ld} \ln\left(\frac{r2 + t}{r2}\right) \quad (3)$$

Figure 1A:
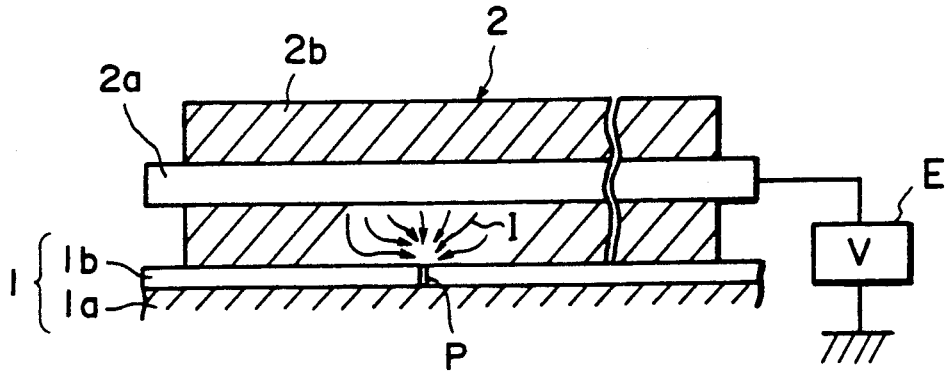
FIG. 1A shows a longitudinal sectional view of a charging device according to an embodiment of the present invention.
Figure 1B:
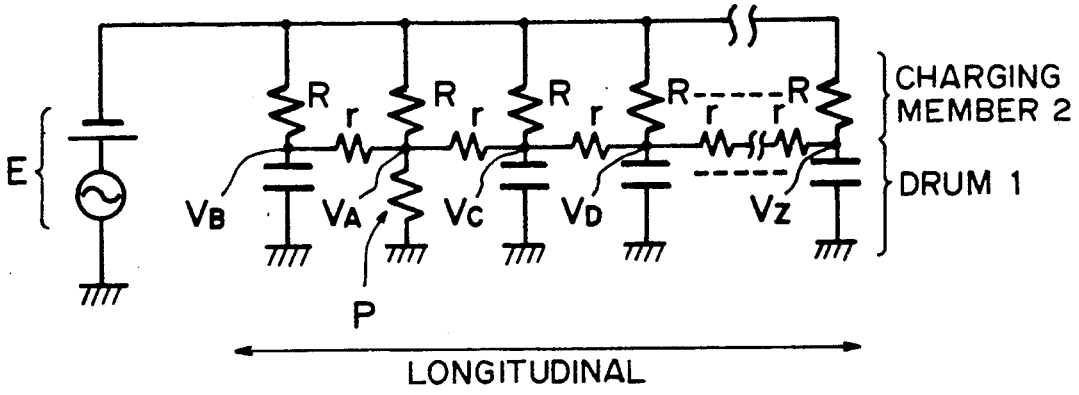
FIG. 1B shows an equivalent electric circuit of a conventional charging device
Figure 5:
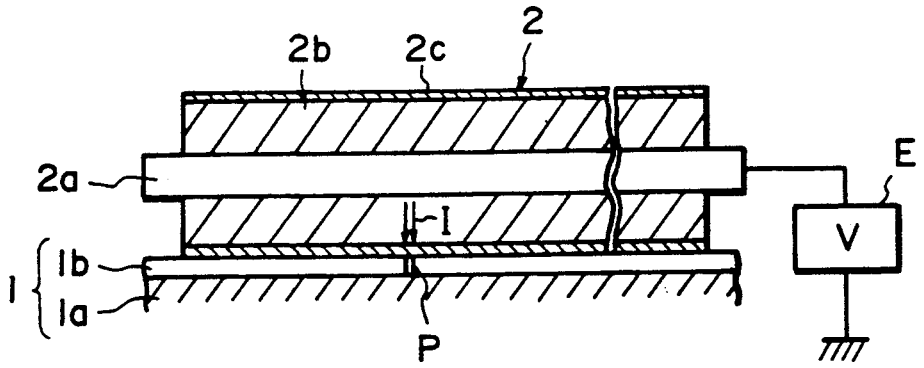
FIG. 5 is a longitudinal sectional view of the FIG. 4 device.

Since in this embodiment, the volume resistivity $\rho 2$ of the first layer 2c is larger than the volume resistivity $\rho 1$ of the second layer 2b, as described hereinbefore, the logarithmic component of the resistance increase ΔR is low when the thickness t of first layer 2c is small, and therefore, the resistance of the roller does not significantly increase. FIGS. 5A and 1A are longitudinal sectional view of the charging roller of FIGS. 3 and 4, respectively, wherein the path of the current I through a pin hole P from the charging roller 2 is shown, the pin hole P having been produced by being hit by some member or the like.

In the case of FIG. 1A wherein the charging roller has the layer 2b only, a large current I flows through the pin hole P and along the surface layer of the roller from around the pin hole, and therefore, the current flowing path is increased due to the pin hole P with the result of the voltage drop. Accordingly, the longitudinal region of the photosensitive member including the pin hole does not receive the electric charge, so that the longitudinal linear area is not charged.

On the contrary, according to this embodiment of the present invention, the resistance of the surface layer 2c contacted to the photosensitive member 1 is high, so that the current into the pin hole through the surface layer of the roller is small, and therefore the voltage drop is small.

In other words, since the volume resistivity of the surface layer 2c contacted to the member to be charged is larger than the volume resistivity of the layer 2b behind the surface layer, the voltage applied from the external voltage source E is efficiently applied across the contact area between the charging roller and the member to be charged, and in addition, even if the flaw is produced on the surface of the photosensitive member, the excessive current is 0 prevented from flowing, thus preventing the significant voltage drop.

Figure 6:
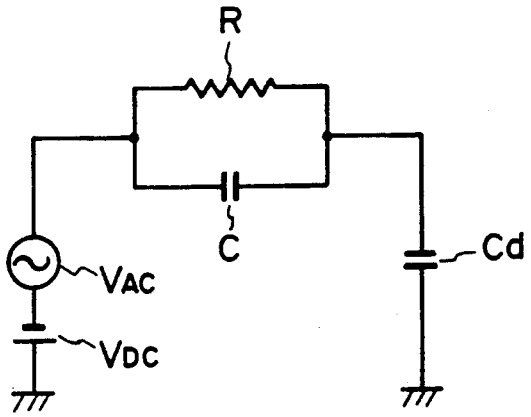
FIG. 6 shows an equivalent circuit diagram of the conventional charging device

FIG. 6 shows an equivalent circuit of the contact type charging device having the surface layer 2c and the resistance and dielectric layer. The resistance R of the charging roller 2 is approximately $10^7$ ohm, and the electrostatic capacity C is approximately 1800 pF. The resistance and the electrostatic capacity are on the basis of 1 $cm^2$ of the roller surface. The electrostatic capacity Cd of the photosensitive drum 1 per 1 $cm^2$ is approximately 1400 pF.

Since in this Figure, $$R >> (\tfrac{1}{2}\pi fC), \text{ and } C >> Cd$$

$\frac{1}{2}\pi fC$: impedance of the electrostatic capacity of the charging roller, the AC voltage $V_{AC}$ which is effective to make uniform the charging of the photosensitive drum 1 can be applied to the photosensitive drum substantially without loss. In the above inequation, f is a frequency of the AC voltage $V_{AC}$, generally f=50–2000 Hz. Here, the sign of inequation ">>" means sufficiently large difference, and it is preferably different by one order or more. Since the resistance R of the charging roller 2 is sufficiently large, the leakage of current is limited substantially at the pin hole, even if it is produced on the photosensitive drum 1, and therefore, the voltage drop of the voltage source does not occur. Since the impedance component provided by the electrostatic capacity of the roller is smaller than the impedance component provided by the resistance, the leakage can be prevented by the large resistance R, and the AC voltage effective to make the charging uniform can be applied to the photosensitive drum without attenuation by the existence of the capacity C (FIG. 6). Further, since the electrostatic capacity of the roller is larger than the electrostatic capacity of the photosensitive drum, the impedance component of the electrostatic capacity of the roller is smaller than the impedance component of the electrostatic capacity of the drum, the AC voltage can be applied to the photosensitive drum without attenuation.

Figure 7:
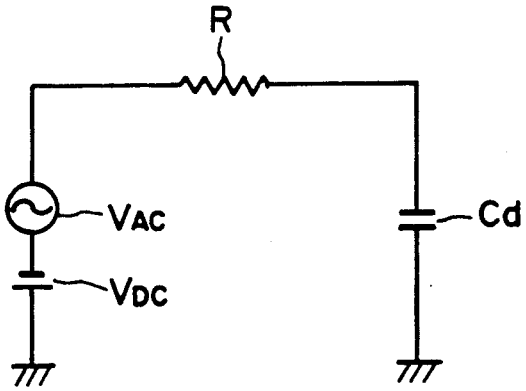
FIG. 7 shows an equivalent circuit of the charging device according to an embodiment of the present invention.

Referring to FIG. 7, there is shown an equivalent circuit of a conventional charging roller 2 shown in FIG. 4. Here, if the resistance R is decreased, the leakage occurs when the photosensitive drum has a pin hole or holes. If the resistance is increased, the leakage can be prevented, but if $R \geqq \frac{1}{2}\pi fCd$, that is, if the impedance component of the resistance of the charging roller is not less than the impedance component of the electrostatic capacity of the drum, the AC voltage $V_{AC}$ is attenuated by the charging roller and is not sufficiently applied to the photosensitive drum, resulting in non-uniform charging.

According to this embodiment, the problems are solved, and when an AC voltage $V_{AC}$ having a frequency of 1000 Hz and a peak-to-peal voltage of 1500 Vpp superposed with −750V DC voltage $V_{DC}$ (substantially the same as the conventional voltages) is applied from the voltage source E, and when the photosensitive drum is rotated at a peripheral speed of 22 mm/sec, the photosensitive drum 1 is uniformly charged to −750V. In addition, even if the pin hole is produced in the photosensitive drum 1, the voltage of the voltage source E by the leakage through the pin hole and the charging roller 2 does not occur. Therefore, a black or white stripe does not appear in the image unlike the conventional case. The pin hole of the photosensitive drum appears in the image as a black or white spot which is so small that it is not a problem usually. In this embodiment, the peak-to-peak voltage of the vibratory voltage applied to the charging roller is not less than twice the absolute value of the charge starting voltage when the charging roller is supplied only with a DC voltage, as disclosed in U.S. Ser. Nos. 131,585 and 159,917 which have been assigned to the assignee of this application. Here, the vibratory voltage is a voltage which periodically change with time, and the waveform may be sine, triangular, rectangular or the like form. 0 The charge starting voltage is determined in the following manner. The charging roller or member is contacted to a member to be charged having a surface potential of zero, and only a DC voltage is applied to the charging member. The DC voltage is increased, and the surface potential of the member to be charged is plotted in a surface potential vs. applied DC voltage graph. The voltage is increased with increment of 100 V. The first point of the voltage is the one which the surface potential of the member to be charged appears, and ten surface potentials are plotted at each 100V increment. Using least square approximation, a straight line is drawn from the plots. The DC voltage reading at which the straight line and the line representing the zero surface potential cross is deemed as the charge starting voltage.

Figure 8:
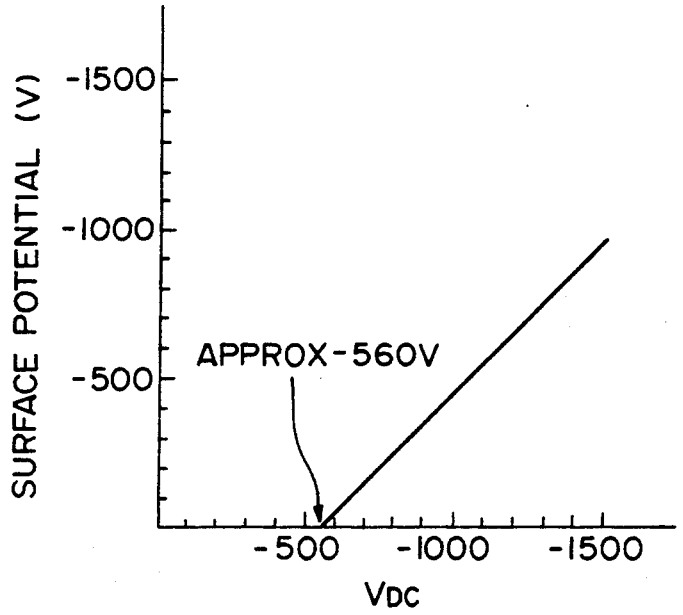
FIG. 8 is a graph showing a relationship between a DC voltage applied to the charging member and the surface potential of the member to be charged.

FIG. 8 is a graph illustrating an example of the above method. The charge starting voltage was −560 V in this embodiment. If the peak-to-peak voltage is determined so as to be larger than twice the charge starting voltage, the charging can be effected uniformly.

Figure 9:
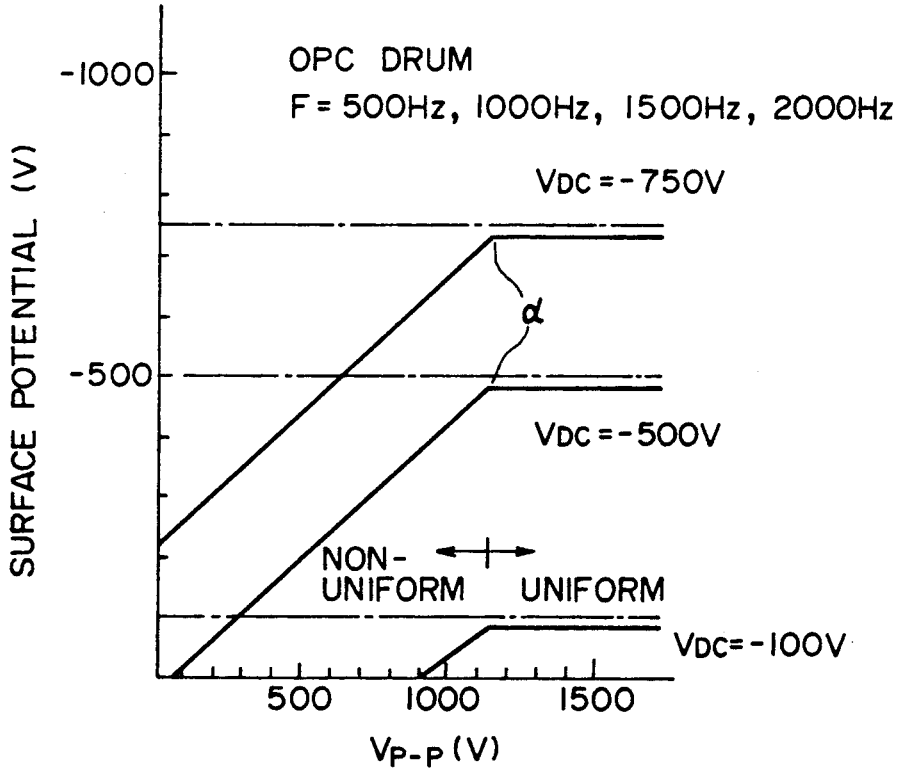
FIG. 9 is a graph showing a relationship between a peak-to-peak voltage of the vibratory voltage applied to the charging member and the surface potential of the member to be charged.

FIG. 9 is a graph of a peak-to-peak voltage of the vibratory voltage applied to the charging roller vs. a surface potential of the OPC photosensitive drum, when the DC voltage is −750, −500, −100V. When the peak-to-peak voltage of the vibratory voltage is gradually increased to such an extent that it is not less than twice the absolute value (560V) of the charge starting voltage, then the surface potential of the photosensitive member becomes uniform.

Figure 10:
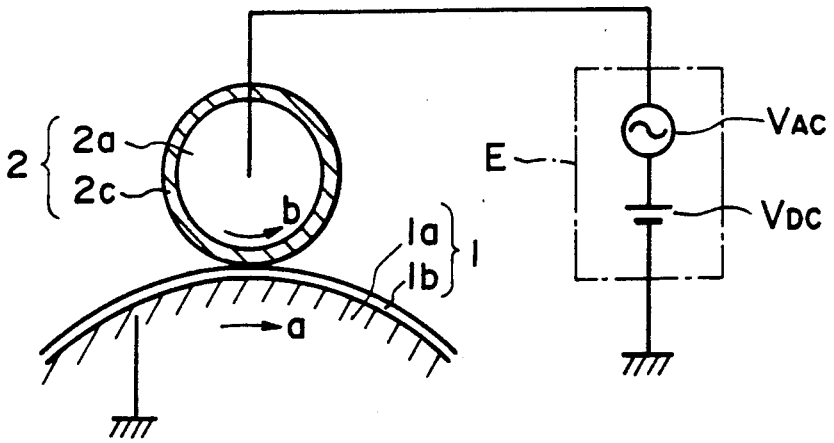
FIGS. 10, 11A, 13–19, 23, 24 are sectional views of charging devices according to other embodiments of the present invention.

FIG. 10 shows a contact type charging device according to another embodiment of the present invention, wherein the same reference numerals are assigned to the elements having corresponding functions, and the detailed description thereof is omitted.

The charging roller 2 is of two layer structure having a metal roller 2*a* and a surface resistance and dielectric layer as a surface layer 2*c* on the surface of the metal roller 2*a*. The surface layer is of NBR rubber having a thickness of 15 microns. The resistance R of the charging roller 2 is approximately $10^7$ ohm, and the electrostatic capacity C is approximately 1500 pF, which satisfy the abovedescribed conditions $R>(\frac{1}{2}\pi fC)$ and $C>Cd$, and therefore, the advantages same as those described with the foregoing embodiment can be provided. Since the charging roller 2 does not have the conductive elastic layer in this embodiment, the member to be charged such as the photosensitive drum or the like is preferably has high hardness. The charging roller of this embodiment is different from the conventional charging roller as shown in FIG. 4 in that the charging roller 2 of this embodiment is provided with a surface resistance and dielectric layer, and therefore, the AC voltage is not attenuated by the charging roller so that the photosensitive member is uniformly charged, and the leakage can be prevented.

FIG. 11 shows a contact type charging device according to a further embodiment. In this embodiment, the charging member is in the form of a blade codirectionary contacted to the photosensitive drum 1 at a predetermined pressure. The blade 12 includes a metal supporting member 12 to which a voltage is supplied and a conductive rubber 12*b* having a sufficiently low resistance. The blade 12 is provided with a surface layer 12*c* which is a resistance and dielectric layer, where it is contacted to the photosensitive drum 1. The surface layer 12*c* is made of CR rubber having a thickness of 10 microns. The resistance R of the charging member is approximately $10^7$ ohm/1 $cm^2$, and the electrostatic capacity C is approximately 1800 pF/1 $cm^2$. Since those values satisfy the above described conditions, the same advantageous effects are provided.

Specific examples will be described.

EXAMPLE 1

A metal core (base) 2*a* having a diameter of 8 mm was coated with the second layer 2*b* having a thickness of 4 mm and having a resistance of $10^4$ ohm.cm in which carbon was dispersed. It was further coated with the first, that is, surface layer 2*c* made of cellophane having a thickness of 25 microns and volume resistivity of $10^9$ ohm.cm. The charging roller 2 was supplied with a vibratory voltage produced by superposing a DC voltage with an AC voltage having a peak-to-peak voltage which was not less than twice the charge starting voltage to the OPC photosensitive drum, more particularly, the supplied voltage was produced by an AC voltage having a peak-to-peak voltage of 1300 Vpp and a frequency of 1 KHz with a DC voltage of 700V. The OPC photosensitive drum was charged to approximately 700V. It was confirmed that even if an OPC photosensitive drum which had a pin hole having a diameter of approximately 1 mm, the voltage drop does not occur, and the insufficient charging in the form of a stripe did not occur.

EXAMPLE 2

A metal core (conductive base) 2*a* having a diameter of 6 mm was coated with cylindrical nitrile butyl rubber having a thickness of 3 mm and having a volume resistivity of $10^3$ ohm.cm in which carbon was dispersed. It was further coated with the first layer 2*c* of nylon having a thickness of 50 microns and the volume resistivity of $10^{10}$ ohm.cm. The charging roller 2 thus produced was contacted to the OPC photosensitive drum. Similarly to the above Example 1, the charging roller 2 was supplied with a superposed AC and DC voltage (1300 Vpp, 1 KHz AC and 700V DC). The OPC photosensitive drum was driven at a peripheral speed of 22 mm/sec. The surface of the OPC photosensitive drum was charged up to approximately 700V. A pin hole having a diameter of approximately 1 mm was formed, and the charging operation was performed. It was confirmed that the voltage drop did not occur, and the uniform charging was provided.

EXAMPLE 3

A charging blade 12 was produced. The conductive member 12*b* (second layer) was produced by dispersing carbon in chloroprene rubber, and the charging blade 12 had a resistivity of $10^2$ ohm.cm, a rubber hardness of 60 degrees and a thickness ta of 1 mm.

That surface of the conductive member 12*b* faced to the photosensitive member 1 was coated with the first layer 12*c* having a thickness of tb. As for the material for the resistance layer 12*c*, usable materials are nylon such as AMILAN (trade name) available from Toray Kabushiki Kaisha, Japan and TORESIN (trade name), available from Teikoku Kagaku Sangyo Kabushiki Kaisha, Japan, material in which the above is dispersed in proper contents, polyurethane rubber, polyurethane elastomer, NBR, chloroprene rubber, PVdF, PVdCl, PFT or the like.

The thickness tb of the resistance layer 12*c* of such material was 50 microns. An end surface of the conductive member 12*b* is coated with a material of the resistance layer in the thickness of 200 microns (a). The coating was produced beforehand in a larger thickness, and it was cut accurately with the precision of several microns.

The charging blade 12 was inclined at an angle $\theta$ relative to the photosensitive member 1. More particularly, the angle between a tangent plane and the downstream side of the photosensitive member with respect to movement direction of the photosensitive member was 15 degrees, and the contact width h was about 1–2 mm.

The charging blade 12 was contacted to the surface of the photosensitive drum 1 having an aluminum drum coated with an organic photoconductive material, which was rotated at a peripheral speed of 50 mm/sec. The metal supporting member 12*a* of the charging blade 12 is supplied with a voltage provided by superposing a DC voltage $V_{DC}$ of −700V and an AC voltage $V_{AC}$ having a peak-to-peak voltage Vpp of 1400V to charge the surface of the photosensitive member, and the charging and leakage properties were investigated.

The charging property is evaluated in the following manner. When the charging blade 12 contacted to the photosensitive member 1 is supplied with the voltage provided by superimposing a DC voltage $V_{DC}$ and an AC voltage $V_{AC}$ having a peak-to-peak voltage Vpp which is not less than twice the charge starting voltage relative to the photosensitive member, the photosensitive member is charged, as shown in FIG. 9, to a potential which is substantially equal to the DC voltage $V_{DC}$. Therefore, the charging property is deemed as being good, when the surface potential of the photosensitive member is approximately equal to $V_{DC}$.

The leakage property is deemed good when nocharge portion does not appear.

Figure 12:
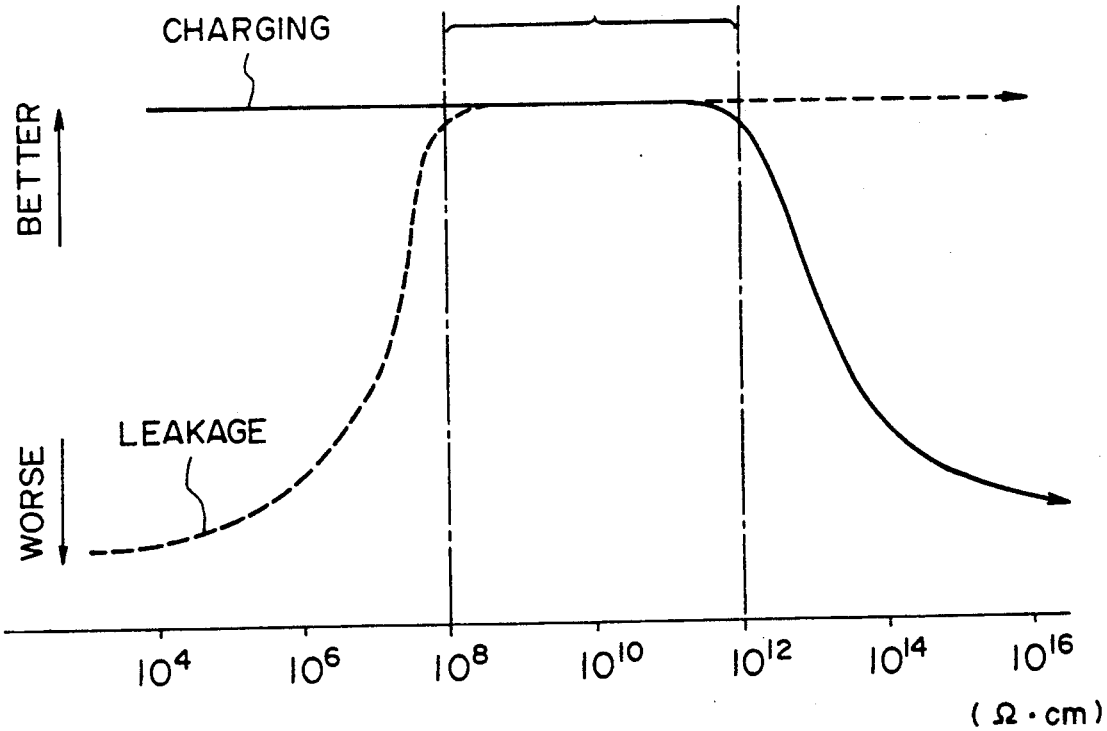
FIG. 12 is a graph illustrating the charging property and the leakage property with respect to a volume resistivity of the surface resistance layer of a contact charging blade.

FIG. 12 shows the results. As will be understood from this Figure, when the film thickness tb of the resistance layer 12*c* of the charging blade 12 is 50 microns, the charging property and the leakage property which are contradictory, are satisfactory when the resistance is $10^8$–$10^{12}$ ohm.cm.

The volume resistivity is determined by measuring the resistance of 1 $cm^2$ resistance layer 12*c* with applied voltage of 10–1000V and calculating on the basis thereof since, the values of the respective material of the resistance layer are sometimes slightly different from those given in encyclopedia or catalogue or the like.

The material of the resistance layer 12*c* provided good results are AMILAN, TORESIN and a mixture of AMILAN and TORESIN and polyurethane elastomer or NBR having a decreased resistance by dispersing conductive particles.

An end surface of the conductive member 12*b* of the charging blade 12 is preferably coated with the resistance layer, since then dust or foreign matter in the air or on the portion of the photosensitive drum surface which is not sufficiently cleaned are prevented by the contact of the blade 12 with the rotating photosensitive member 1 from reaching the downstream charging area with respect to the rotational direction of the photosensitive member, and therefore, a partial insufficient charging is avoided.

Figure 13:
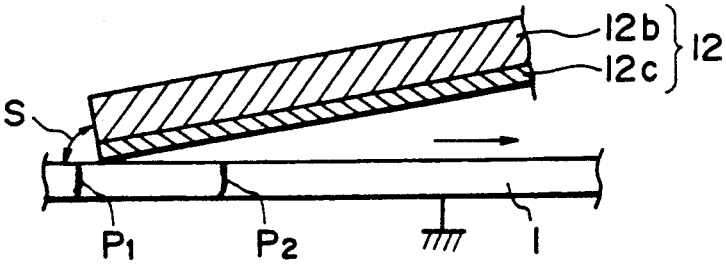

When the edge is not coated, as shown in FIG. 13, spark discharge S due to the leakage current takes place at a position of pin hole P1 resulting in insufficient charge, although the spark discharge does not take place at a position P2. The spark discharge result in production of insufficient charge portion.

Figure 11A:
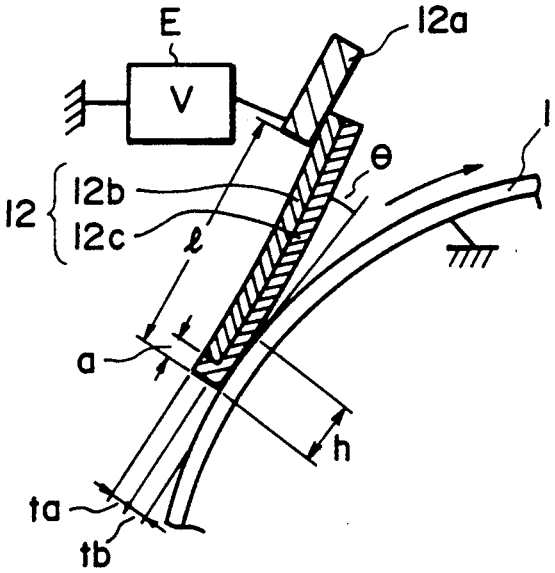

In this example, the charging blade 2, as shown in FIG. 11A, is coated with the resistance layer 12*c* and a at the surface of the conductive member 12*b* facing the photosensitive member 1 and at the edge thereof, so that the spark discharge does not occur.

EXAMPLE 4

AMILAN was used as the resistance layer 12*c*and the layer thickness tb is changed within the range of 5–200 microns, and the similar experiments were performed as in the third example to investigate the charging and leakage properties.

The charging property was good (OK), but the leakage property was no good (NG) if the layer thickness tb is not more than 10 microns. It was found that this was because a pin hole was produced due to dielectric brake down of AMILAN so that the spark discharge occurred when it is contacted to the pin hole, resulting in leakage of the current. Therefore, it was confirmed that a film thickness is required.

By the experiments with other materials with the thickness tb changed, it was confirmed that the thickness was preferably not less than 20 microns to be safe with respect to the leakage even if it is damaged.

EXAMPLE 5

In Example 3, a charging blade 12 which did not exhibit the leakage was used, and a conductive paint ($10^5$ ohm.cm) was painted on the resistance layer 12*c*. It was confirmed that the leakage took place.

Figure 11B:
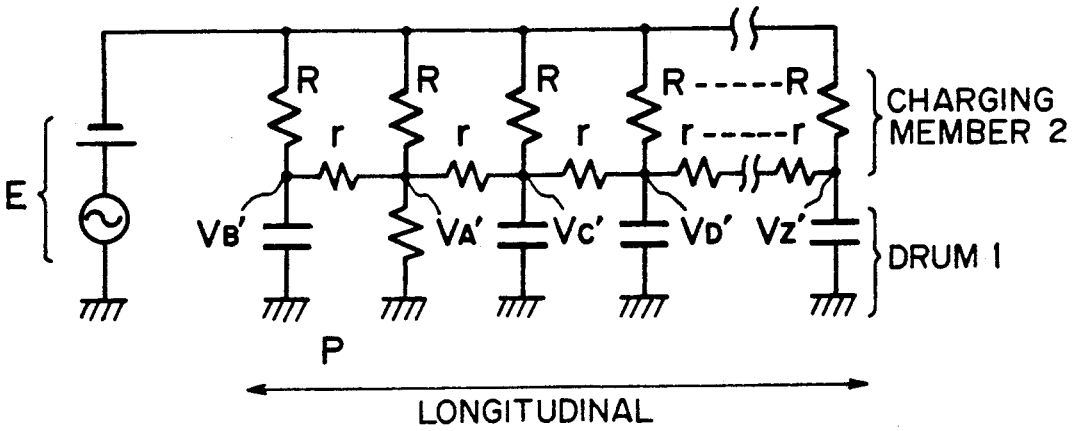
FIG. 11B is an equivalent circuit of a charging device according to an embodiment of the present invention.

As a result of this Example and the Example 3, the resistance of the surface of the charging blade 12 is influential to the leakage. An equivalent circuit when the surface resistance layer 12*c* is provided is shown in FIG. 11B. In this case, even if the photosensitive member 1 has a pin hole, the voltage applied to the photosensitive member $V'_A$ becomes nearly equal to 0V only at a position where the pin hole P is present, but the voltage at the other portions $V'_B$–$V'_Z$ are maintained because of the surface resistance r of the resistance layer 12*c*, so that no leakage occurs.

The lower limit of the resistance preventing the leakage was confirmed as being $10^8$ ohm.cm by Example 3.

EXAMPLE 6

AMILAN having a thickness of 200 microns was used as a resistance layer 2*c* and the angle $\theta$ between the charging blade 12 and the photosensitive member 1 was changed, and similar experiments were performed. The angle $\theta$ was changed within the range of 5 degrees–60 degrees. It was confirmed that, the charging property was no good when the angle was larger than 40 degrees.

Figure 14A:
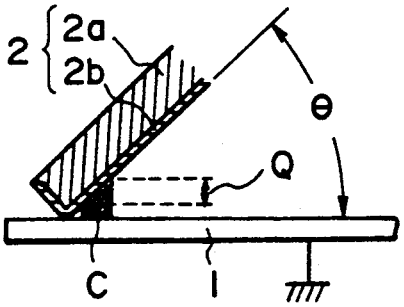
Figure 14B:
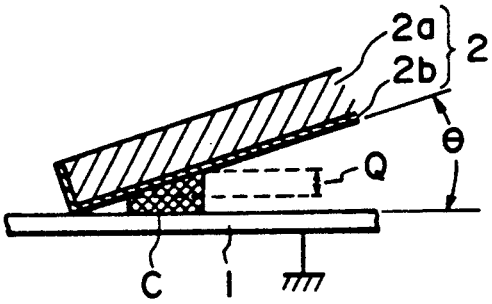

As shown in FIGS. 14A and 14B, when the charging is performed with the same applied voltage conditions, the discharging distance range Q provided by the Paschen's law does not change, but the discharging region C becomes smaller with increase of the angle $\theta$. This is considered as being the reason for the bad charging. From this, it is understood that the angle $\theta$ is preferably smaller to provide good charging property.

EXAMPLE 7 (FIG. 15)

The charging blade 12 had the resistivity of $10^2$ ohm.cm and included a conductive urethan rubber 0 blade having a thickness of 1 mm as the conductive member 12*b* and a resistance layer 12*c* made of TORESIN or AMILAN having a thickness of 50 microns and having a resistivity of $10^9$–$10^{11}$ ohm.cm at both surfaces and edges.

The charging blade 2 was contacted to the surface of the photosensitive member 1 with the angle $\theta$ of 10 degrees, the free part length $l=7$ mm and contact width h of 1 mm, and the voltage was applied to contact-charge the surface of the photosensitive member. Uniform and good charging was provided.

The applied voltage was provided by superposing a DC voltage of −700V and an AC voltage of 1400 Vpp and 500 Hz. The resultant surface potential of the photosensitive member was substantially −700V.

When a pin hole was deliberately produced for the purpose of experiment to confirm the leakage property, it was confirmed that no leakage occurred.

Since the entire surface of the conductive member 12b was covered with a resistance layer 12c, the blade was not curved (it is sometimes curved when the resistance layer is applied only on one side (FIG. 11A)), the contact between the photosensitive member was uniform so that the non-uniformness in the form of stripes of the charging was not produced.

EXAMPLE 8 (FIG. 16)

The charging blade 12 of this Example had a chloroprene sheet having a thickness of 1.5 mm and a resistivity of $10^2$ ohm.cm as the conductive member 12b, and a polyurethane elastomer having a thickness of 50 microns and the resistivity of $10^{10}$ ohm.cm was applied on the sheet as a resistance layer 12c. The two layer material (12b and 12c) was cut into a proper size and shape and was used as the charging blade. The cut edge was coated with a coating layer a made of a polyurethane elastomer having a thickness of 100 microns and a resistivity of $10^{15}$ ohm.cm, since otherwise the conductive member 12b is exposed.

The polyurethane elastomer having the volume resistivity of $10^{15}$ ohm.cm used as the coating layer a at the edge of the conductive member had a hardness of 65 degrees, and was used usually as a cleaning blade, so that the property of close contact and the sliding relative to the photosensitive member was very good. The angle $\theta$ was 10 degrees, and the free portion length was 10 mm, and therefore, the line pressure relative to the photosensitive member is not more than 5 g/cm. Therefore, the photosensitive member is not damaged with good charging property. There is no problem about the leakage property.

EXAMPLE 9 (FIG. 17)

The charging blade 12 comprised a conductive EPTM sheet material having a thickness of 1 mm and the hardness of 70 degrees and having a resistivity of $10^2$ ohm.cm as the conductive member 12b. It was dipped in liquid of TORESIN, AMILAN, NBR or the like, and then it is dried to form the resistance layer 2c. The thickness of the resistance layer 12c was 70 microns at maximum. The resistance layer 12c was applied in the region from an edge faced to the photosensitive member to 4 mm therefrom, and the remainder was not coated. The free portion length 1 was 8 mm.

The photosensitive member 1 was contactcharged using discharging blade 12, and it was confirmed that the charging property was good. As to the leakage property, since the resistance layer 12c was not formed over the entire surface of the side of the conductive member 12b faced to the photosensitive member 1, but the distance between the conductive member 12b and the pin hole of the photosensitive member was sufficient, and therefore, the spark discharge did not occur.

EXAMPLE 10 (FIG. 18)

The charging blade 12 had the same structure as with FIG. 11A. However, the charging blade 12 was codirectionally contacted to the photosensitive member 1 although in FIG. 11A, it was contacted counterdirectionally.

As regards the charging property, it is preferable that the surface of the charging blade is gradually spaced apart from the photosensitive member toward downstream of the photosensitive member with respect to the rotational direction thereof, since then the charging is uniform. However, the problem is not significant even if the blade 12 is contacted codirectionally.

Figure 15:
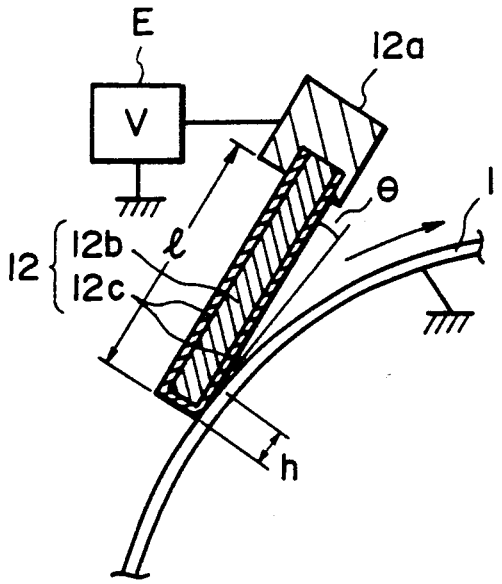
Figure 16:
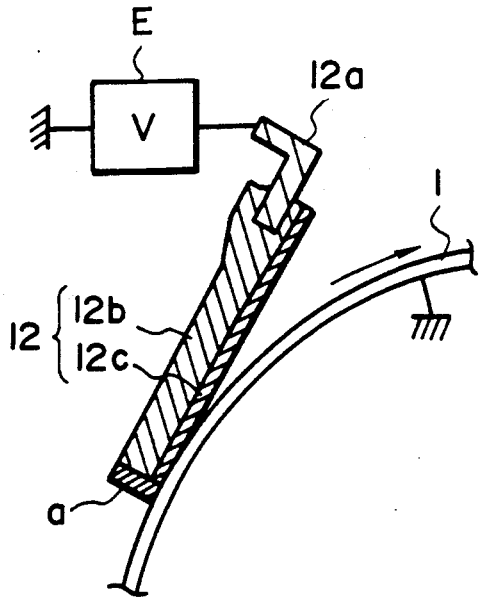
Figure 17:
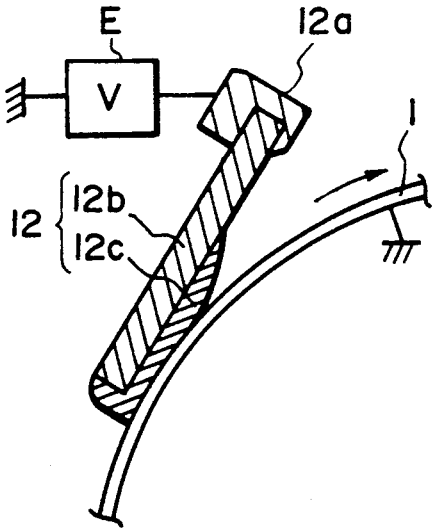
Figure 18:
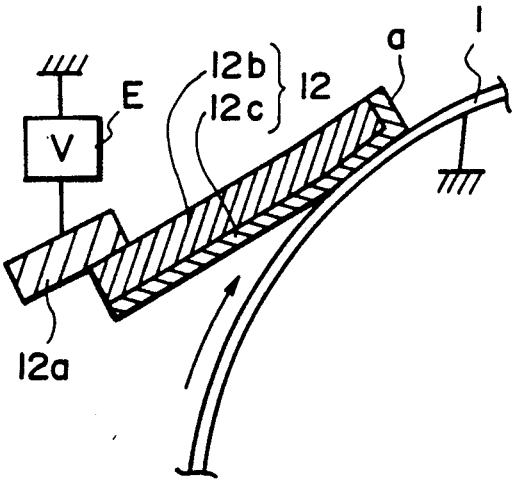
Figure 19:
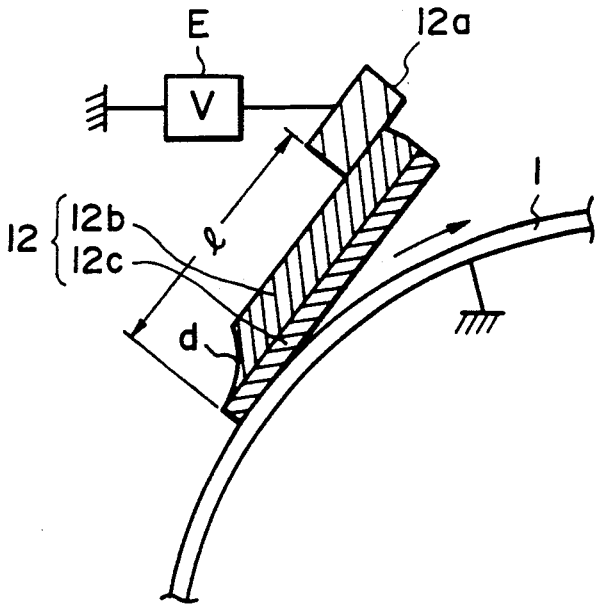

The charging blade 12 counter-directionally contacted to the photosensitive member 1 shown in FIGS. 15-17, may be contacted codirectionally.

EXAMPLE 11 (FIG. 19)

The charging blade 12 in this Example comprises polyurethane elastomer having a thickness of 1 mm and a resistivity of $10^2$ ohm.cm as the conductive member 12b. The end surface thereof is cut into a round surface d. The resistance layer 12c is made of a polyurethane elastomer sheet having a thickness of 100 microns and the resistivity of $10^{10}$ ohm.cm. It was fused by heat on that surface of the conductive member 12b which is faced to the photosensitive member 1 without air therebetween. The formation of the round surface is effective to decrease the ridigity of the charging blade, and therefore, even if the free portion length 1 is as small as 5 mm, the pressure to the photosensitive member 1 is not large.

When the photosensitive member 1 was contactcharged by discharging blade 12, the results were good. As to the leakage, there was no problem. With this structure, the spark discharge could be prevented without the coating of resistance layer on the end surface of the conductive member 12b.

As described hereinbefore, the ridigity of the end portion of the blade can be decreased, so that the photosensitive member is protected from damage by the charging member 12.

When the charging member is made of rubber in this embodiment, the surface layer of the charging member is preferably made of resin having a parting property relative to the image bearing member, since then it can be avoided that the softening agent contained in the rubber oozes out and is deposited on the image bearing member to form a film of a toner on the image bearing member and that the flow of the image is produced. Particularly, the nylon resin having a parting property in the foregoing Examples is formed as the surface layer of the charging member with good advantages.

The description will be made as to the relationship between the volume resistivity and the thickness of the surface layer of the charging member contacted to the image bearing member which is a member to be charged. In the following description, the potential change at each portion when the charging member is supplied with a superimposed DC and AC voltages is deemed equivalent to the change in the transient state when a DC voltage is applied to the charging member.

As described hereinbefore, when the photosensitive member has a pin hole, a spark discharge is produced by which an excessive current flows from the charging member to the pin hole, with the result that the photosensitive member is not charged. This is because, the current is so large that it is beyond the capacity of the voltage source for the charging member, and therefore, the voltage output from the voltage source is decreased to such an extent that the charging function to the photosensitive drum is performed.

As for the measure dealing with the spark discharge, a large capacity is given to the voltage source so that the output voltage thereof is not significant even if the charging member is opposed to the pin hole, resulting in a current larger than usual current.

Then, $$P > E^2/R \quad (4)$$

P: capacity of the voltage source

R: resistance of the charging roller at the pin hole

E: voltage by the voltage source is preferably satisfied.

From the definition of the volume resistivity, the following results:

$$R=\rho(l/A) \quad (5)$$

$\rho$:volume resistivity of a high resistance layer at the contact area between the charging member and the member to be charged.

l: a thickness of the high resistance layer of the charging member

A: cross-sectional area of a pin hole

Here, the high resistance layer is a layer having a resistance which is sufficiently larger than the resistance of the layer behind itself, so that the resistance is negligibly small as compared with the high resistance layer. The high resistance layer is defined here as a layer having a resistance not less than $10^3$ times the resistance of the layer therebehind. In this case, the resistance of the charging member is deemed as the same as the resistance of the high resistance layer. Then, the following results:

$$\rho l>(E^2/P)A$$

If this is satisfied, the insufficient charging due to the spark discharge does not occur if $\rho$ and l satisfy the above. If $A=(1\times10^{-3})^2$ ($m^2$), for example, E has DC component of −750V and AC component of 1500V (Vpp), and P is 10W, for example, the following results:

$$\rho l > \frac{(-750)^2+\left(\frac{1500}{2}/\sqrt{2}\right)^2}{10}\times(1\times10^{-3})^2 = 8.44\times10^{-2}\ \text{ohm}\cdot\text{m}^2 \quad (7)$$

If the thickness of the high resistance layer at a contact area between the charging member and the member to be charged is 3.0 mm, for example, the following results:

$$\rho>2.81\times10^1\ \text{ohm m} \quad (8)$$

In the case of the charging roller shown in FIG. 4, in order to prevent the leakage by the pin hole of the photosensitive drum, the resistance is preferably high. It has been found through experiments by the applicants that the resistance of the charging roller at the nip between the charging roller and the photosensitive drum is preferably approximately $1.14\times10^{10}$ ohm in consideration of the reduction of the resistance by moisture absorption by the charging roller under a high humidity condition.

However, when the voltage applied to the charging roller having this resistance is 1600 Vpp AC voltage, the experiments have revealed that only 0.05 micro-Amperes flows through the voltage source. As a result, the AC voltage is not effective to make the charge on the photosensitive member uniform, and therefore, the non-uniform discharge resulted.

Then, a charging roller 2 having a three layer structure as shown in FIG. 3 was used. The inside layer 2*b* of the charging roller 2 was made of a material having the volume resistivity of $10^1$ ohm.m, and the material of the outer layer 2*c* (the high resistance layer) was selected so that the resistance at the nip portion (sum of the inside layer and the outside layer) is substantially equal to the resistance ($1.14\times10^{10}$ ohm) of the single layer. Then, the outer layer 2*c* has a larger volume resistivity, and simultaneously, it also acquires an electrostatic capacity.

As a result, the AC current through the charging roller was 0.6 mA in experiments. And, the non-uniformness of the charging of the photosensitive drum was eliminated. It is considered that this is because, in the model of FIG. 6, the charging roller has the dielectric layer and also has an electrostatic capacity, so that even if the resistance R is large, the AC current flows through the capacitance C. To do this, as described hereinbefore the impedance ($\frac{1}{2}\pi fC$) of the capacitance C is preferably smaller than the resistance R. Also, it is effective that the electrostatic capacity of the charging member is larger than that of the member to be charged.

The high resistance layer in the contact area between the charging member and the photosensitive drum is not limited to the case where the layer 2*c* includes a single layer as shown in FIG. 3, but it may be of a multi-layer structure. For example, it includes a layer of nylon or AMILAN or the like contactable to the drum and a layer of LBR or other rubber behind it.

If the measure for dealing with the spark discharge produced by a larger pin hole, and the measure for reducing the non-uniformness of the charging by applying a larger AC current, are considered, the resistance and the electrostatic capacity of the charging roller at the nip is preferably more limited.

Therefore, the material of the outside layer 2*c* of the charging roller was further investigated. Depending on the material, the surface potential of the charging roller decreases gradually with the rotation of the roller, and finally, the photosensitive drum can not be charged to the predetermined voltage.

By way of calculation, the change in the surface potential of the charging roller 2 is obtained to determine the proper range of the resistance and the electrostatic capacity of the outer layer 2*c* of the charging roller 2, in the following manner.

First, the voltage change through one full turn of the charging roller was obtained using the equivalent circuit. Next, a saturated surface potential of the charging roller surface when the integrated number of rotations is infinite, that is, when the image forming operation is continuously performed. Further, the surface potential of the charging roller with which the photosensitive drum can be charged is empilically determined. Thereafter, the resistance and the electrostatic capacity ranges of the outside layer 2*c* of the charging roller satisfying the above are determined.

Figure 20:
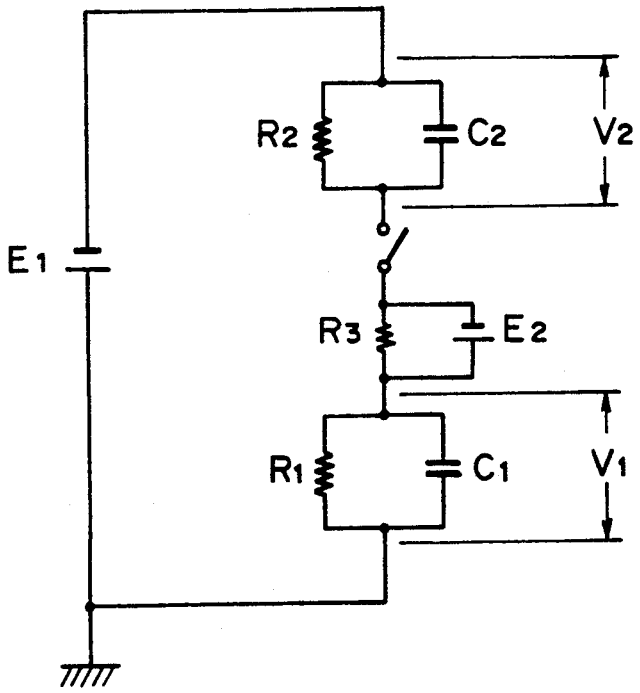
FIG. 20 is an equivalent circuit diagram of a charging device according to an embodiment of the present invention

FIG. 20 shows an equivalent circuit constituted by the charging roller 2 and the photosensitive drum 1 in the charging roller 2 shown in FIG. 3. Here, for the purpose of better simulation than the FIG. 6 simulation, the resistance of the photosensitive drum and the charge starting voltage of the photosensitive drum to the charging roller are taken into account.

In FIG. 20, C1, R2 are electrostatic capacity and resistance of the photosensitive drum 1 at the nip portion; C2, R2 are electrostatic capacity and the resistance of the charging roller 2 at the nip; R3 is a charging resistance; E1 is the applied voltage; and E2 is a potential difference between the charging roller surface and the drum surface when the charging of the photosensitive drum starts when the DC voltage to the charging roller is gradually increased, the photosensitive drum having the surface potential of 0V. This is the instance when the discharge from the roller to the drum starts, and the current at this time is nearly equal to zero, and therefore, the voltage drop by the roller itself is not produced. Thus, E2 can be deemed as the charge starting voltage described above. In FIG. 20, V1, V2 are voltages applied to the photosensitive drum 1 and to the charging roller 2; S is a switch which is closed when a particular portion of the periphery of the charging roller comes to the nip, and is opened when it departs from the nip.

Figure 21:
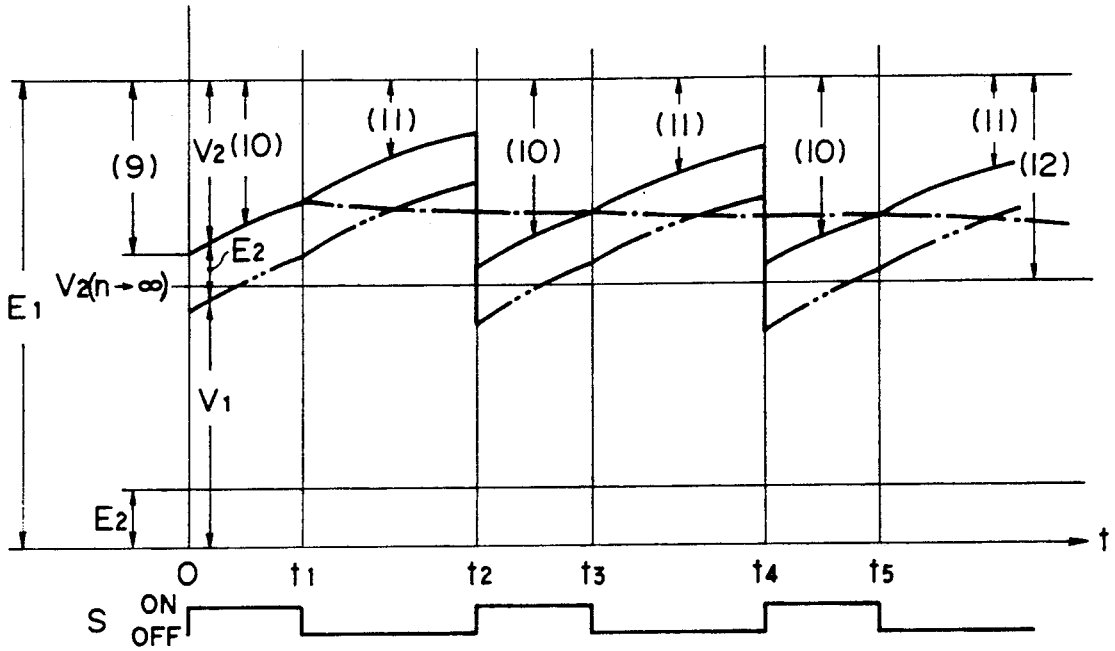
FIG. 21 is a graph showing a change of the surface potential with time.

FIG. 21 shows the change in the surface potential of the charging roller resulting from the equivalent circuit of FIG. 20 (E1-V2). In this Figure, $t_1$ is the time required for the charging roller passes through the nip, and $t_2$ is the time required for the charging roller rotates through one full turn.

A particular portion of the charging roller is noted, and the time t=0, when the particular portion approaches the nip formed between the photosensitive drum and the charging roller by the rotation, and the discharge starts. The time is $t_1$ when the particular portion departs from the nip, and the discharge ends. During this period, the switch Sw is considered to be closed.

The discharge starts at the nip portion after the charging roller 2 rotates through one turn at the time $t_2$. During the period represented by $t_1 \leqq t \leqq t_2$, the charging roller 2 is away from the nip so that the discharge does not occur, the switch Sw is opened. During this period, the electric charge $q_2$ in the capacitance C2 attenuates by discharge through the resistance R2. This means that the charging roller 2 having been electrically charged is electrically discharged by the leakage of the current, that is, the residual charge is removed.

If a part of the charging roller is completely discharged during the charging roller rotates through one turn, the voltage V2 between the core metal of the charging roller and said one portion becomes zero, by which the surface potential of the portion E1 is E1-V2. However, as shown in FIG. 21, if there is the residual charge when the portion reaches the nip after one full turn, and the surface potential does not return to E1, the residual charge is accumulated on the charging roller through the second, third and subsequent rotations, and therefore, the voltage V2 applied to the charging roller immediately before the nip increases gradually. Therefore, the surface potential V1 of the photosensitive drum decreases gradually. Strictly speaking, the electric discharge occurs where the charging roller and the photosensitive drum is spaced apart with a small clearance, and therefore, the charging area has a width which is slightly large than the nip formed between the charging roller and the photosensitive drum. However, such a small clearance region is sufficiently negligibly small as compared with the nip width, and therefore, the charging area is considered as being equal to the nip.

The voltage V2 applied to the charging roller when t=0 is expressed as follows:

$$\frac{(E1 - E2)C1 + V2(o)C2}{C1 + C2} \tag{9}$$

$V_{2(o)}$: initial voltage of the charging roller which is a voltage of the charging roller when the previous charge is retained before the rotation of the charging roller starts.

The voltage of the charging roller at the nip is:

$$\frac{R2(E1 - E2)}{R1 + R2} - \left(\frac{C2(E1 - E2) - V2(o)}{C1 + C2} - \frac{R1(E1 - E2)}{R1 + R2}\right)\exp X \tag{10}$$

where $$X = -\frac{(R1 + R2)t}{(C1 + C2)R1R2}$$

The voltage of the charging roller when the portion considered is again introduced into the nip after it is once departed from the nip, is:

$$\frac{R2(E1 - E2)}{R1 + R2} + \left(\frac{R1(E1 - E2)}{R1 + R2} - \frac{C2(E1 - E2 - V2(o))}{C1 + C2}\right)\exp X \exp Y \tag{11}$$

$$X = -\frac{(R1 + R2)t1}{(C1 + C2)R1R2}$$

$$Y = \frac{-t}{R2C2}$$

With rotation of the charging roller, the voltage of the charging roller changes, satisfying the above equations (9), (10) and (11).

The surface potential of the charging roller at the time when the portion considered is departed from the nip is indicated by a chain line in FIG. 21.

As for the case where the number of rotation of the charging roller is infinite, the final voltage $V_2(n=\infty)$ at the time when the portion departs the nip, is expressed as follows:

In FIG. 21, (9)-(12) designate the parts represented by the above equations (9)-(12). The chain lines with two dots indicate the change in the surface potential of the photosensitive drum. This is always lower than the surface potential (E1-V2) of the charging roller by E2.

FIG. 21 shows the case where the absolute value of the final (saturated) surface potential (E1-V2(n=∞)) of the charging roller is larger than the absolute value of the potential difference E2 between the charging roller surface and the photosensitive drum surface when the charge of the photosensitive drum starts. This means that the resistance and the electrostatic capacity of the outside layer 2c of the charging roller are sufficient to move electric charge from the charging roller to the photosensitive drum.

When the saturated surface potential of the charging roller is to be measured in experiments, the photosensitive drum is continuously charged, and the potential thereof at the position where a portion considered departs the nip, and the measurements are plotted on a graph of potential vs. time. The potential gradually reaches the final potential, and asymptotic line is determined as the saturated potential. The range is provided from the above equation (12) as follows.

$$|E1 - V_{2(n=\infty)}| > |E2| \quad (13)$$

$$V_{2(n=\infty)}$$

$$\frac{\left(\frac{R2(E1-E2)}{R1+R2} + \left(\frac{R1}{R1+R2} - \frac{C2}{C1+C2}(E1-E2)\exp X\right)\exp - \frac{t2-t1}{R2C2}\right.}{1 - \frac{C2}{C1+C2}\exp\left(X - \frac{t2-t1}{R2C2}\right)}$$

$$X = \frac{-(R1+R2)t1}{(C1+C2)R1R2}$$

As an example, the applied voltage E1= −1300 V, the resistance R1 of the photosensitive drum at the nip is $4.00\times10^{12}$ ohm, and the electrostatic capacity C1=$3.10\times10^{-10}$ F.

The times t, $t_2$ are obtained by the following through actual measurements.

$t_1$=(nip width)/(peripheral speed of the charging roller)=1 (mm)/22 (mm/s)=$4.54\times10^2$ (s)

$t_2$=rotational period of the charging roller= (circumferential length of the charging roller)/(peripheral speed of the charging roller)=12 (mm)×$\pi$/22 (mm/s)=1.71 (s)

The potential difference E2 between the charging roller surface and the photosensitive drum surface when the charging of the photosensitive drum starts was measured as −560V (=E2). The photosensitive member was an OPC photosensitive member. The voltage is dependent on the polarity of the applied voltage and the electrostatic capacity of the photosensitive member.

With the above-described conditions, the ranges of the resistance R2 and the electrostatic capacity to satisfy that the surface potential of the charging roller is not less than E2 which is the potential difference between the roller surface and the drum surface at the time of the charge start, when the charging roller is continuously operated and is rotated through infinite turns, can be introduced from the above equation (12). The result of calculation is shown in FIG. 22.

Figure 22:
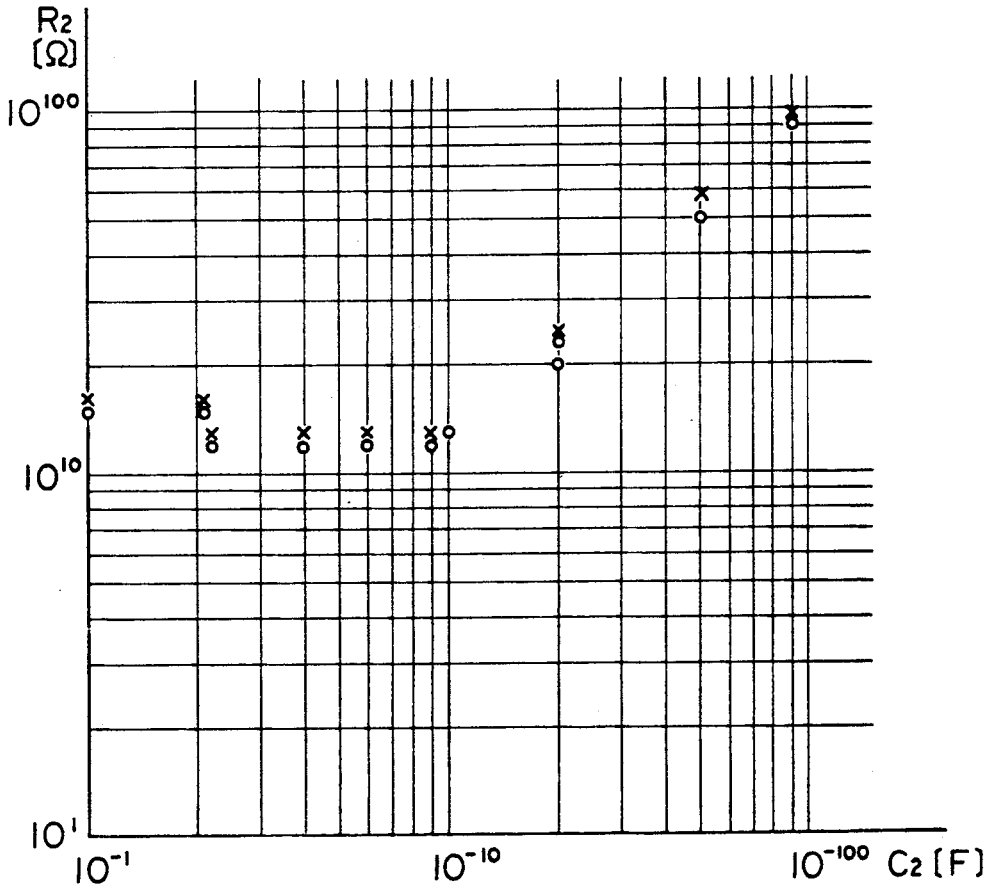
FIG. 22 shows a relationship between the resistance and the electrostatic capacity in the cases where the saturated surface potential of the charging member is the potential difference between the surface potential of the charging member and the surface potential of the member to be charged when the charging to the member to be charged starts.

In FIG. 22, "o" designates the resistance R2 and the capacitance C2 with which the voltage difference (E1-V2) is larger than the voltage E2, and "x" designates the resistance R2 and the capacitance C2 with which the voltage difference (E1-V2) is smaller than the voltage E2.

As will be apparent from this Figure, the voltage (E1-V2) is larger than the voltage E2 if the following is satisfied:

(1) When C2>$10^{-2.1}$(F), R2≦$10^{15}$ (ohm)

(2) When $10^{-2.1}$(F)>C2≧$10^{-9}$(F), R2≦$10^{12}$ (ohm)

(3) When C2<$10^{-9}$(F), R2≦$10^4$/C2

The volume resistivity $\rho$ when l=100 microns is introduced from the above equation (7), as follows:

$$\rho > 8.44\times10^{-2}\times(100\times10^{-6})^{-1} = 8.44\times10^2 \text{ (ohm.m)} \quad (14)$$

The resistance R2 of the nip portion when the outside layer 2*c* has the volume resistivity satisfying the above considering that the resistance of the layer behind the high resistance layer is sufficiently smaller than that of the high resistance layer, and therefore, it is negligible small, is obtained as follows.:

$$R2 = \frac{\rho}{2\pi L} \times \ln\frac{r2}{r1} \times \frac{2\pi r2}{d}$$

r1: radius of the inside of the surface layer
r2: radius of the roller
d: nip width
L: length of the roller
From equation (14), $$R2 > \frac{8.44\times10^2}{2\pi\times220\times10^{-3}} \times \ln\frac{6}{6-100\times10^{-3}} \times \frac{2\pi\times6\times10^{-3}}{10^{-3}} = 3.87\times10^2 \text{ (ohm)}$$

Therefore, from the results (1), (2) and (3), the range of the resistance R2 is as follows:

(4) When C2>$10^{-2.1}$ (F), 3.87×10 (ohm) <R2 <=1015 (ohm)

(5) When $10^{-2.1}$(F)>C2>$10^{-9}$ (F), $3.87\times10^2$ (ohm-)<R2≦$10^{12}$ (ohm)

(6) When C2<$10^{-9}$(F), $3.87\times10^2$ (ohm-)<R2≦$10^4$/C2

Next, as for the cellulose acetate having a thickness of 25 microns which is in the "o" zone in FIG. 22 (R2=$1.14\times10^{10}$ ohm, C2=$3.89\times10^{-10}$), used for the outside layer 2*c* of the charging roller 2, the following results are obtained. When the photosensitive drum 1 is continuously rotated with E1= −1300V, and the saturated potential is measured as −380V which is substantially coincident with the surface potential of −378V of the photosensitive drum obtained by the equation (12). This probes that the equivalent circuit is corrected. In the equivalent circuit, the voltage E1 is a DC voltage, but when a vibratory voltage is considered, the voltage E1 is an effective value thereof.

Even when a pin hole was produced on the photosensitive drum, the leak does not occur, and uniform and stabilized charging and images were obtained.

Figure 23:
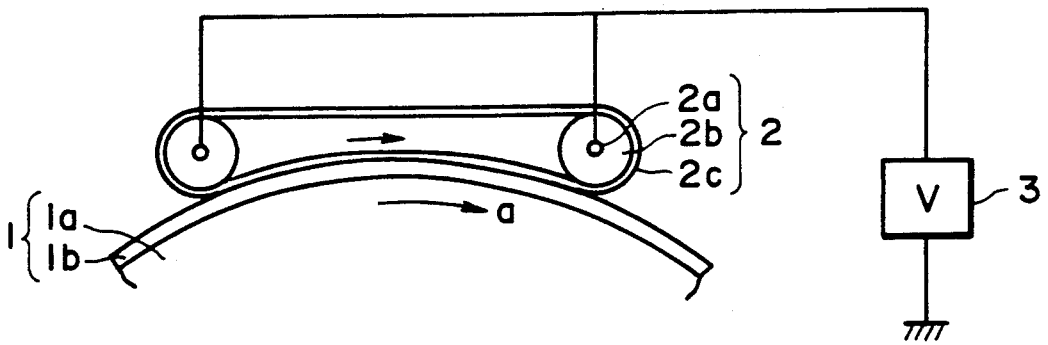

In the description, the charging member has been in the form of a roller, but as shown in FIG. 23, the outside layer 2*c* (the high resistance layer) of the charging roller 2 is in the form of a belt. With this structure, the time for the residual charge in the outside layer 2*c* to dissipate is made longer, so that the recovery of the charging power is promoted. As a result, the resistance of the material of the outside layer 2*c* is allowed to be further larger, thus providing a wider latitude of material selection. Further, if it is in the form of a belt, the charging width is made larger to ensure the charging.

Figure 24:
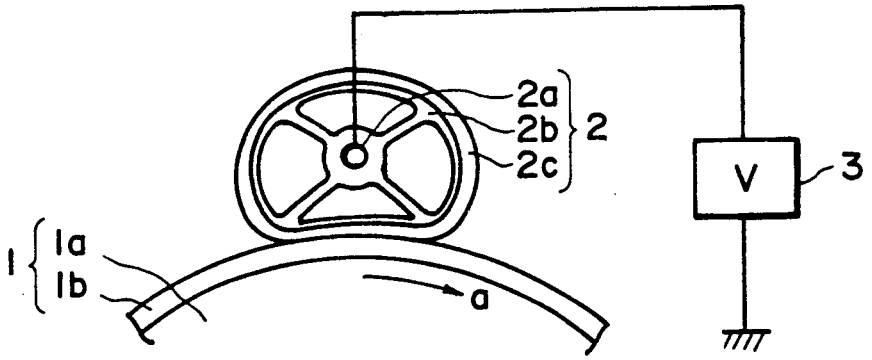

As shown in FIG. 24, the inside layer 2*b* of the charging roller may be a hollow honeycomb shape or spongelike shape. In this case, it is possible to easy obtain a relatively wide nip width, and therefore, the advantages provided by the belt form can be provided.

The foregoing description has been made with the pin hole having an area of 1 $mm^2$ as an example, but in the case of high quality image formation, the pin hole having the area of 0.01 $mm^2$ (0.1 mm $\times$0.1 mm) is to be considered. As will be understood, in that case, the inequation (6) is expressed as follows:

$$\rho l > E^2 \times (0.1 \times 10^{-3})^2 / P \text{ (ohm.m}^2\text{)}$$

In the foregoing description, the polarity of the external voltage was negative, but the same description applies to the case where the voltage is positive.

The photosensitive member is not limited to the OPC photosensitive member, and the photosensitive member made of amorphous silicon or selenium or the like can be used. The photosensitive member is not limited to the form of drum but may be in the form of a belt or sheet.

The member to be charged is not limited to the photosensitive member, and an insulating drum not having the photosensitive layer can be used.

As described in the foregoing, according to the present invention, in the charging device wherein the charging means supplied with the voltage is contacted to the member to be charged to perform the charging, the leakage current from the charging means to the member to be charged is prevented, and therefore, the no-charge portion of the member is not produced.

Also, it is possible that the member to be charged is charged uniformly. Further, when the charging means is repeatedly operated, the charging power of the charging means can be maintained.

While the invention has been described with reference to the structures disclosed herein, it is not confined to the details set forth and this application is intended to cover such modifications or changes as may come within the purposes of the improvements or the scope of the following claims.

What is claimed is:

1. A charging device for charging a moving member to be charged, comprising:

charging means for being contacted to the member to be charged to charge the member;

means for applying a voltage to said charging means, wherein the voltage has a peak-to-peak voltage which is not less than twice of an absolute value of a charge starting voltage relative to the member;

wherein said charging means includes a first layer contactable to the member to be charged, a second layer adjacent thereto wherein the first layer is a dielectric layer having a volume resistivity larger than that of the second layer.

2. A device according to claim 1, wherein the voltage is superposed DC and AC voltage.

3. A device according to claim 1, wherein said charging means is in the form of a rotatable roller.

4. A device according to claim 1, wherein said charging means is in the form of a blade.

5. A device according to claim 3, wherein said charging means rotates following movement of the member.

6. A device according to claim 1, wherein the second layer of said charging means is a rubber layer.

7. A device according to claim 1 or 6, wherein the first layer of said charging means is a resin layer.

8. A device according to claim 7, wherein the first layer of said charging means is of nylon resin.

9. A device according to claim 6, wherein the first layer of said charging means is a rubber layer.

10. A device according to claim 6, wherein a core member is provided inside the second layer of said charging means.

11. A device according to claim 1, wherein the second layer of said charging means is a core member.

12. A device according to claim 11, wherein the first layer of said charging means is a rubber layer.

13. A device according to claim 1, wherein an impedance component of an electrostatic capacity of said charging means is smaller than an impedance component of a resistance thereof.

14. A device according to claim 13, wherein the electrostatic capacity of said charging means is larger than the electrostatic capacity of the member to be charged.

15. A device according to claim 1, wherein the member to be charged is an image bearing member.

16. A device according to claim 15, wherein said image bearing member is a photosensitive member.

17. A charging device for charging a moving member to be charged, comprising:

charging means for being contacted to the member to be charged to charge the member;

means for applying a vibratory voltage to the charging means;

wherein said charging means includes a surface dielectric layer at a contact portion with the member, and the impedance component of the electrostatic capacity of said charging means is smaller than the impedance component of the resistance thereof.

18. A device according to claim 17, wherein the electrostatic capacity of said charging means is larger than that of the member to be charged.

19. A device according to claim 17, wherein the vibratory voltage is a superposed DC and AC voltage.

20. A device according to claim 17, wherein a peak-to-peak voltage of the vibratory voltage is not less than twice the absolute value of the charge starting voltage relative to the member to be charged.

21. A device according to claim 17, wherein said charging means is in the form of a rotatable roller.

22. A device according to claim 17, wherein said charging means is in the form of a blade.

23. A device according to claim 21, wherein said charging means rotates following movement of the member to be charged.

24. A device according to claim 17, wherein a layer behind the surface layer at the contact portion is a rubber layer.

25. A device according to claim 17 or 24, wherein the surface layer of said charging means is a resin layer.

26. A device according to claim 25, wherein the surface layer of said charging means is a nylon resin layer.

27. A device according to claim 24, wherein the surface layer at the contact portion with the member to be charged is a rubber layer.

28. A device according to claim 24, wherein a core member is provided behind the rubber layer.

29. A device according to claim 17, wherein the layer behind the surface layer is a core member.

30. A device according to claim 29, wherein the surface layer of said charging means is a rubber layer.

31. A device according to claim 17, wherein the member to be charged is an image bearing member.

32. A device according to claim 31, wherein said image bearing member is a photosensitive member.

33. A charging device for charging a moving member to be charged, comprising:

charging means for being contacted to the member to be charged to charge the member;

means for applying a voltage to said charging wherein said charging means includes a high resistance layer at a portion where it is contacted to the member to be charged, and the following is satisfied:

$$\rho l > E^2 \times (0.1 \times 10^{-3})^2 / P \text{ (ohm.m}^2)$$

where $\rho$ is a volume resistivity (ohm.m) of the high resistance layer, l (m) is a thickness of the high resistance layer, E is the voltage (V) applied by said voltage applying means, P is a capacity (W) of a voltage source of said voltage applying means.

34. A device according to claim 33, wherein said voltage is a vibratory voltage.

35. A device according to claim 34, wherein the voltage is a superposed DC and AC voltage.

36. A device according to claim 33, wherein said charging means is in the form of a rotatable roller.

37. A device according to claim 36, wherein said charging means rotates following movement of the member to be charged.

38. A device according to claim 33, wherein the high resistance layer of said charging means is a resin layer.

39. A device according to claim 33 or 38, wherein a rubber layer is provided behind the high resistance layer of said charging means.

40. A device according to claim 39, wherein a core member is provided behind the rubber layer of said charging means.

41. A device according to claim 33, wherein the high resistance layer of said charging means includes a resin layer at a portion of contact with the member to be charged, and a rubber layer behind the resin layer.

42. A device according to claim 41, wherein a rubber layer is provided behind the high resistance layer, and a core member is provided behind the rubber layer.

43. A device according to claim 41, wherein a core member is provided behind the high resistance layer.

44. A device according to claim 33, wherein the high resistance layer is a rubber layer.

45. A device according to claim 44, wherein a rubber layer is provided behind the high resistance layer, and a core member is provided behind the rubber layer.

46. A device according to claim 44, wherein a core member is provided behind the high resistance layer.

47. A device according to claim 33, wherein the high resistance layer is a dielectric layer, and wherein an impedance component of an electrostatic capacity of said charging means is smaller than an impedance component of a resistance thereof.

48. A device according to claim 47, wherein the electrostatic capacity of said charging means is larger than the electrostatic capacity of the member to be charged.

49. A device according to claim 33, wherein the member to be charged is an image bearing member.

50. A device according to claim 49, wherein said image bearing member is a photosensitive member.

51. A charging device for charging a moving member to be charged, comprising:

charging means for being contacted to the member to be charged to charge the member;

means for applying a voltage to said charging means, wherein said charging means includes a high resistance layer at a portion where it is contacted to the member to be charged, and the following is satisfied:

$$\rho l > E^2 \times (0.1 \times 10^{-3})^2 / P(\text{ohm.m}^2)$$

where in $\rho$ is a volume resistivity (ohm.m) of the high resistance layer, l (m) is a thickness of the high resistance layer, E is the voltage (V) applied by said voltage applying means, P is a capacity (W) of the voltage source of said voltage applying means;

wherein R2 of said charging means at a nip between said charging mean and the member to be charged and an electrostatic capacitance C2 of said charging means at this nip satisfy:

$$|E1[E2] - V_{2(n=\infty)}| > |E2|$$

where $$V_{2(n=\infty)} = \frac{\left[\frac{R2(E1-E2)}{R1+R2} + \left(\frac{R1}{R1+R2} - \frac{C2}{C1+C2}\right)(E1-E2)\exp X\right]\exp - \frac{t2-t1}{R2C2}}{1 - \frac{C2}{C1+C2}\exp\left(X - \frac{t2-t1}{R2C2}\right)}$$

$$X = \frac{-(R1+R2)t1}{(C1+C2)R1R2}$$

where $E1-V_{2(n=\infty)}$ is a saturated voltage of said charging means, E1 is a voltage (V) applied to said charging means, C1 is a electrostatic capacity of the member to be charged at the nip, R1 is a resistance of the member to be charged at the nip, $t_1$=(a width of the nip)/(a peripheral speed of said charging means)

$t_2$=(a peripheral length of said charging means)/(a peripheral speed of said charging means)

wherein E2 is a charge starting voltage of the member to be charged.

52. A device according to claim 51, wherein said voltage is a vibratory voltage.

53. A device according to claim 52, wherein the voltage is a superposed DC and AC voltage.

54. A device according to claim 51, wherein said charging means is in the form of a rotatable roller.

55. A device according to claim 54, wherein said charging means rotates following movement of the member to be charged.

56. A device according to claim 51, wherein the high resistance layer of said charging means is a resin layer.

57. A device according to claim 51 or 56, wherein a rubber layer is provided behind the high resistance layer of said charging means.

58. A device according to claim 57, wherein a core member is provided behind the rubber layer of said charging means.

59. A device according to claim 51, wherein the high resistance layer of said charging means includes a resin layer at a portion of contact with the member to be charged, and a rubber layer behind the resin layer.

60. A device according to claim 59, wherein a rubber layer is provided, behind the high resistance layer, and a core member is provided behind the rubber layer.

61. A device according to claim 59, wherein a core member is provided behind the high resistance layer.

62. A device according to claim 51, wherein the high resistance layer is a rubber layer.

63. A device according to claim 62, wherein a rubber layer is provided behind the high resistance layer, and a core member is provided behind the rubber layer.

64. A device according to claim 62, wherein a core member is provided behind the high resistance layer.

65. A device according to claim 51, wherein the high resistance layer is a dielectric layer, and wherein an impedance component of an electrostatic capacity of said charging means is smaller than an impedance component of a resistance thereof.

66. A device according to claim 65, wherein the electrostatic capacity of said charging means is larger than the electrostatic capacity of the member to be charged.

67. A device according to claim 51, wherein the member to be charged is an image bearing member.

68. A device according to claim 67, wherein said image bearing member is a photosensitive member.

69. An apparatus according to claim 16, 32, 50 or 68, wherein said photosensitive member includes an amorphous silicon photosensitive layer.

70. An image forming apparatus, comprising:

a moving image bearing member;

charging means for being contacted to he image bearing member to charge the image bearing member;

means for applying a voltage to said charging means, wherein the voltage has a peak-to-peak voltage which is not less than twice of an absolute value of a charge starting voltage relative to the member;

wherein said charging means includes a first layer contactable to the member to be charged, a second layer adjacent thereto, wherein the first layer is a dielectric layer having a volume resistivity larger than that of the second layer.

71. An apparatus according to claim 70, further comprising a process unit detachably mountable to said apparatus and containing said image bearing member and said charging means.

72. An image forming apparatus, comprising:

a movable image bearing member;

charging means for being contacted to said image bearing member to charge the image bearing member;

means for applying a vibratory voltage to the charging means;

wherein said charging means includes a surface dielectric layer at a contact portion with the image bearing member, and the impedance component of the electrostatic capacity of said charging means is smaller than the impedance component of the resistance thereof.

73. An apparatus according to claim 72, further comprising a process unit detachably mountable to said apparatus and containing said image bearing member and said charging means.

74. An image forming apparatus, comprising:

a movable image bearing member;

charging means for being contacted to said image bearing member to charge the image bearing member;

means for applying a voltage to said charging means;

wherein said charging means includes high resistance layer at a portion where it is contacted to the image bearing member, and the following is satisfied:

$$\rho l > E^2 \times (0.1 \times 10^{-3})^2 / P(\text{ohm.m}^2)$$

where in $\rho$ is a volume resistivity (ohm.m) of the high resistance layer, l (m) is a thickness of the high resistance layer, E is the voltage (V) applied by said voltage applying means, P is a capacity (W) of the voltage source of said voltage applying means.

75. An apparatus according to claim 74, further comprising a process unit detachably mountable to said apparatus and containing said image bearing member and said charging means.

76. A process unit detachably mountable to an image forming apparatus, comprising:

an image bearing member;

charging means for being contacted to the image bearing member to charge the image bearing member, wherein a charging voltage has a peak-to-peak voltage which is not less than twice of an absolute value of a charge starting voltage relative to the member;

wherein said charging means includes a first layer contactable to the image bearing member, a second layer adjacent thereto wherein the first layer is a dielectric layer having a volume resistivity larger than that of the second layer.

77. A process unit detachably mountable to an image forming apparatus, comprising:

an image bearing member;

charging means for being contacted to the image bearing member to charge the image bearing member, said charging means being supplied with a vibratory voltage;

wherein said charging means includes a surface dielectric layer at a contact portion with the image bearing member, and the impedance components of the electrostatic capacity of said charging means is smaller than the impedance component of the resistance thereof.

78. A process unit detachably mountable to an image forming apparatus, comprising:

an image bearing member;

charging means for being contacted to the image bearing member to charge the image bearing member, said charging means being supplied with a voltage;

wherein said charging means include a high resistance layer at a portion wherein it is contacted to the image bearing member, and the following is satisfied:

$$\rho l > E^2 \times (0.1 \times 10^{-3})^2 / P(\text{ohm.m}^2)$$

where in $\rho$ is a volume resistivity (ohm.m) of the high resistance layer, l (m) is a thickness of the high resistance layer, E is the voltage (V) applied by said charging means, P is a capacity (W) of a voltage source of said voltage applying the voltage.

* * * * *

UNITED STATES PATENT AND TRADEMARK OFFICE

CERTIFICATE OF CORRECTION

PATENT NO. : 5,126,913

DATED : June 30, 1992

INVENTOR(S) : Junji Araya, et al.

It is certified that error appears in the above-identified patent and that said Letters Patent is hereby corrected as shown below:

COLUMN 1

Line 35, "to" should be deleted; and
Line 43, "like" should read --like.--.

COLUMN 2

Line 7, "current" should read --current.--.

COLUMN 3

Line 66, "vention" should read --vention.--.

COLUMN 5

Line 38, "a" should read --with a--; and
Line 39,, "pressure" should read --pressure.--.

COLUMN 7

Line 42, "0" should be deleted.

UNITED STATES PATENT AND TRADEMARK OFFICE

CERTIFICATE OF CORRECTION

PATENT NO. : 5,126,913

DATED : June 30, 1992

INVENTOR(S) : Junji Araya, et al.

It is certified that error appears in the above-identified patent and that said Letters Patent is hereby corrected as shown below:

COLUMN 8

Line 31, "peak-to-peal voltage" should read --peak to peak voltage--; and
Line 54, "0" should be deleted and "The charge" should read --The charge-- (new paragraph).

COLUMN 9

Line 35, "is" should be deleted; and
Line 46, "tionary" should read --tionally--.

COLUMN 11

Line 62, "12cand" should read --12c and--.

COLUMN 13

Line 48, "contactcharged" should read --contact-charged--.

COLUMN 17

Line 42, "the charging" should read --the period in which the charging--.

UNITED STATES PATENT AND TRADEMARK OFFICE

CERTIFICATE OF CORRECTION

PATENT NO. : 5,126,913

DATED : June 30, 1992

INVENTOR(S) : Junji Araya, et al.

It is certified that error appears in the above-identified patent and that said Letters Patent is hereby corrected as shown below:

COLUMN 18

Line 42, after "as follows:", insert $$-- \frac{\left[ \frac{R2(E1 - E2)}{R1 - R2} + \frac{R1}{R1 + R2} - \frac{C2}{C1 + C2} (E1 - E2) - \exp X \right] \exp\left( - \frac{t2 - t1}{R2C2} \right)}{1 - \frac{C2}{C1 + C2} \exp\left[ X - \frac{t2 - t1}{R2C2} \right]}$$

$$X = - \frac{(R1 + R2) + 1}{(C1 + C2)\ R1R2} \quad -- \qquad (12)$$

COLUMN 19

Line 20, "C1 = 3.10 x 10-10F." should read --C1 = 3.10 x $10^{-10}$F.--; and
Line 54, "C2 >" should read --C2 ≥--.

COLUMN 20

Line 34, "C2 >" should read --C2 ≥--;
Line 35, "< = 1015 (ohm)" should read --≤ $10^{15}$ (ohm)--;
Line 36, "C2 > $10^{-9}$(F)" should read --C2 ≥ $10^{-9}$(F)--; and
Line 49, "probes" should read --proves--.

UNITED STATES PATENT AND TRADEMARK OFFICE

CERTIFICATE OF CORRECTION

PATENT NO. : 5,126,913

DATED : June 30, 1992

INVENTOR(S) : Junji Araya, et al.

It is certified that error appears in the above-identified patent and that said Letters Patent is hereby corrected as shown below:

COLUMN 21

Line 1, "easy" should read --easily--.

COLUMN 23

Line 5, "charging " should read --charging means--.

COLUMN 24

Line 16, "$|E1[E2] - V_{2(n = \infty)}| > |E2|$" should read --$|E1 - V_{2(n = \infty)}| > |E2|$--.

COLUMN 25

Line 33, "member to be charged" should read --image bearing member and--.

UNITED STATES PATENT AND TRADEMARK OFFICE

CERTIFICATE OF CORRECTION

PATENT NO. : 5,126,913

DATED : June 30, 1992

INVENTOR(S) : Junji Araya, et al.

It is certified that error appears in the above-identified patent and that said Letters Patent is hereby corrected as shown below:

COLUMN 26

Line 12, "the" should read --a--.

Signed and Sealed this

Fourteenth Day of September, 1993

Bruce Lehman

*Attest:*

BRUCE LEHMAN

*Attesting Officer*

*Commissioner of Patents and Trademarks*